US007089735B1

(12) United States Patent
Qiu et al.

(10) Patent No.: US 7,089,735 B1
(45) Date of Patent: Aug. 15, 2006

(54) CHANNELIZED STRATIFIED REGENERATOR SYSTEM AND METHOD

(75) Inventors: Songgang Qiu, Richland, WA (US); John E. Augenblick, Richland, WA (US)

(73) Assignee: Infinia Corporation, Kennewick, WA (US)

( * ) Notice: Subject to any disclaimer, the term of this patent is extended or adjusted under 35 U.S.C. 154(b) by 0 days.

(21) Appl. No.: 11/057,052

(22) Filed: Feb. 11, 2005

(51) Int. Cl.
*F01B 29/10* (2006.01)

(52) U.S. Cl. ..... 60/517; 60/521; 60/522; 60/524; 60/526

(58) Field of Classification Search ..... 60/517, 60/521, 522, 524, 526
See application file for complete search history.

(56) References Cited

U.S. PATENT DOCUMENTS 4,392,351 A * 7/1983 Doundoulakis ..... 60/526
5,259,197 A * 11/1993 Byung-Mu ..... 62/6
5,303,555 A * 4/1994 Chrysler et al. ..... 62/6
5,642,618 A 7/1997 Penswick
5,743,091 A 4/1998 Penswick et al.
5,895,033 A 4/1999 Ross et al.
6,345,666 B1 * 2/2002 Conrad ..... 165/154
6,694,731 B1 * 2/2004 Kamen et al. ..... 60/524
6,715,285 B1 * 4/2004 Isaac, Jr. ..... 60/520

OTHER PUBLICATIONS

Stan Kolisch, IIT Research Institute, Army to Produce Replacement Parts on Demand in the Field, AMPTIAC Quarterly, vol. 6, No. 3, Rome, NY, USA.
Koji watari and Subhash L. Shinde, Guest Editors, High Thermal Conductivity Materials, MRS Bulletin, www.mrs.org/publication/bulletin, Jun. 2001, pp. 440-441, http://www.k-technology.com/myste.htm May 9, 2005.

* cited by examiner

*Primary Examiner*—Hoang Nguyen
(74) *Attorney, Agent, or Firm*—Brian L. Johnson; Davis Wright Tremaine LLP

(57) ABSTRACT

A channelized stratified regenerator with integrated heat exchangers are disclosed using micromachining to precisely construct structural geometries, such as fins and axial stratification of material to be used in a Stirling cycle based system. In operation, a working fluid passes through the regenerator when traveling between two heat exchangers. In some implementations, the regenerator and the heat exchangers are formed as a single construction. In other implementations, the regenerator and heat exchangers are formed separately, but are constructed to integrate efficiently with one another.

15 Claims, 28 Drawing Sheets

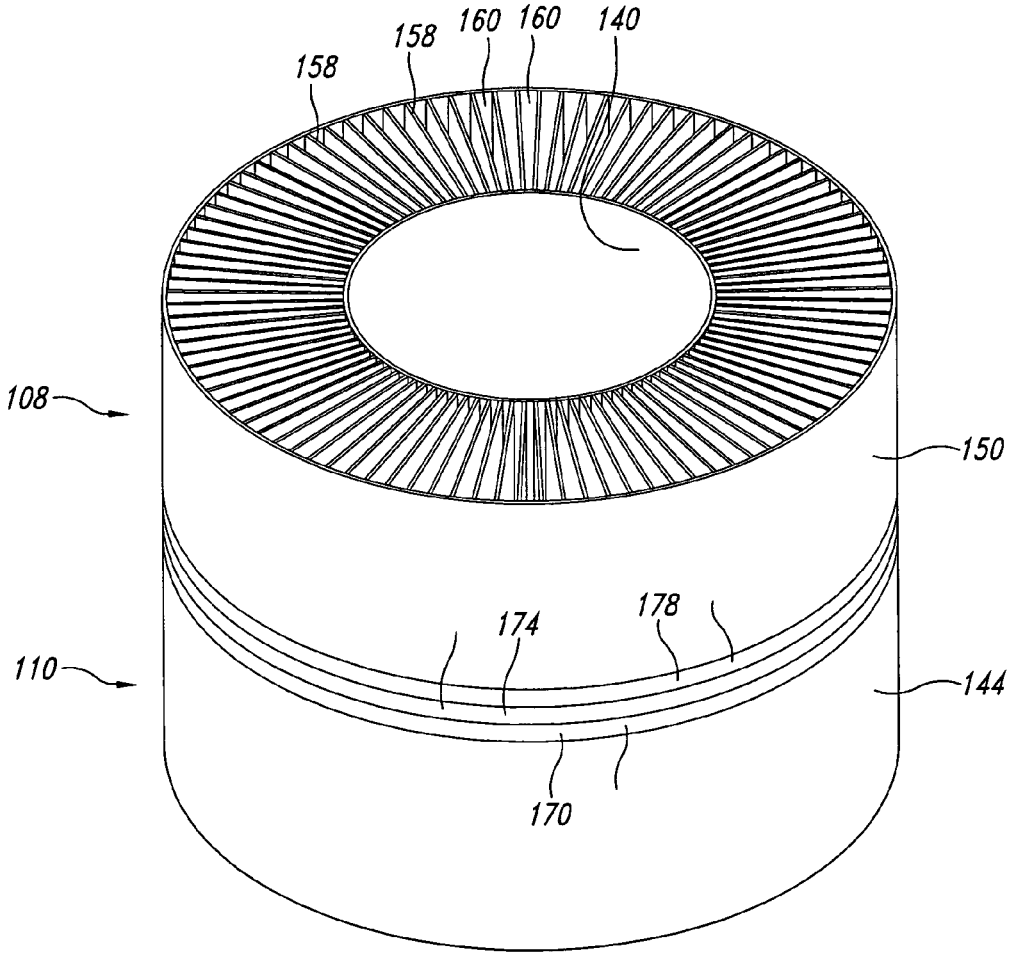
Fig. 16
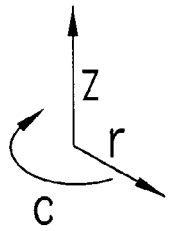

CHANNELIZED STRATIFIED REGENERATOR SYSTEM AND METHOD

BACKGROUND OF THE INVENTION

1. Field of the Invention

The present invention is directed generally to engines and coolers and, more particularly, to Stirling cycle engines and coolers.

2. Description of the Related Art

A conventional Stirling cycle engine or cooler includes a displacer moved by a working fluid, such as a gas. Portions of the working fluid travel in passageways between a hot area and a cold area. As the working fluid travels from the hot area to the cold area, it passes through a conventional random fiber mesh material called a regenerator that retains heat from the working fluid thereby lowering the temperature of the working fluid. As the working fluid returns from the cold area back to the hot area, it receives some heat back from the regenerator thereby resulting in increased efficiency. Unfortunately, manufacture of conventional regenerators can demand extensive highly trained labor with many manufacturing steps.

Conventional regenerators can be difficult to integrate with other components of Stirling cycle engines or coolers, such as heat exchangers. For instance, due to differences in geometries of the conventional regenerators and heat exchangers manifolds are used to maintain uniform flow of the working fluid through the heat exchangers and regenerator. These manifolds contribute to "dead volume" that reduces efficiencies.

Another problem posed by conventional integration of regenerators with heat exchangers is that the regenerators are compressed fitted between the exchangers which adds more variableness to the final porosity of the regenerator both during time of assembly and also through the lifetime of operation. As the conventional regenerator ages, the amount of compression placed upon the regenerator by its fitting between the two heat exchangers can change, which diminishes long term reliability. In some cases compression lessens to a degree in which the regenerators become loose enough to vibrate and oscillate, which can result in shedding of small unwanted particles and subsequent machinery failure.

The random fiber mesh material used in the conventional regenerators is sintered which produces small particles that can migrate throughout the Stirling cycle engine or cooler potentially causing damage. Construction of conventional regenerators provides little in the way of accurate control over either bulk or axial regenerator porosity of the random fiber mesh material. Consequently, extensive operational testing is required to verify performance of conventional regenerators and undesirable amounts of costly scrap materials are produced. Attempted remedies include some conventional regenerators using spaced apart foils, however, spacing between these foils is undesirably inconsistent and unpredictable. Due to drawbacks of conventional regenerators and heat exchangers, reliability and performance of Stirling cycle engines and coolers suffers.

BRIEF SUMMARY OF THE INVENTION

Aspects of the present invention reside in a regenerator for a Stirling cycle based system having a first heat exchanger to transfer heat from a heat source to a working fluid and a second heat exchanger to transfer heat from the working fluid to a heat sink, the first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger.

In some implementations the regenerator has a plurality of fins positioned and spaced apart from one another to form channels, therebetween, the channels being positioned within the Stirling cycle based system to direct at least partial passage of the working fluid between the first heat exchanger and the second heat exchanger along a pathway other than along the first dimension to cause the working fluid to travel a longer distance in going between the first heat exchanger and the second heat exchanger than it would if the working fluid would travel entirely along the first dimension between the first heat exchanger and the second heat exchanger.

Other aspects include the regenerator having a plurality of fins shaped to at least partially twist about the first dimension, the fins positioned and spaced apart from one another to form channels, therebetween, the channels being positioned within the Stirling cycle based system to direct at least partial passage of the working fluid between the first heat exchanger and the second heat exchanger along a pathway at least partially twisting about the first dimension to cause the working fluid to travel a longer distance in going between the first heat exchanger and the second heat exchanger than it would if the working fluid would travel entirely along the first dimension between the first heat exchanger and the second heat exchanger. In some implementations the fins at least partially twist about the first dimension in a substantially spiral form.

Other aspects include the regenerator having a plurality of fins positioned and spaced apart from one another to form channels, therebetween, each channel having a channel width, shape and orientation to achieve a desired amount of porosity for a portion of the regenerator, the fins being positioned and spaced apart to achieve varying amounts of porosity within the regenerator.

Other aspects include the regenerator having a plurality of fins positioned and spaced apart from one another to form channels, therebetween, each channel having a channel width, shape and orientation with respect to the first dimension to achieve varying regenerator porosity dependent at least in part upon location along the first dimension.

Other aspects include the regenerator having a plurality of looping fins, and a plurality of spacers coupled to the looping fins to position and concentrically space apart the looping fins from one another to form concentric channels, therebetween, the spacers being positioned within the Stirling cycle based system to direct at least partial passage of the working fluid through the concentric channels between the first heat exchanger and the second heat exchanger along a pathway other than along the first dimension to cause the working fluid to travel a longer distance in going between the first heat exchanger and the second heat exchanger than it would if the working fluid would travel entirely along the first dimension between the first heat exchanger and the second heat exchanger. In some implementations the looping fins are rings.

Other aspects include the regenerator having a plurality of looping fins, and a plurality of spacers coupled to the looping fins to position and concentrically space apart the looping fins from one another to form concentric channels, therebetween, the spacers shaped to at least partially twist about the first dimension and positioned within the Stirling cycle based system to direct within the concentric channels at least partial passage of the working fluid between the first heat exchanger and the second heat exchanger along a pathway at least partially twisting about the first dimension to cause the working fluid to travel a longer distance in going between the first heat exchanger and the second heat exchanger than it would if the working fluid would travel entirely along the first dimension between the first heat exchanger and the second heat exchanger.

Other aspects include the regenerator having a cylindrical member centrally positioned within the regenerator along the first dimension, the cylindrical member having an exterior surface, and a plurality of fins extending radially from the exterior surface of the cylindrical member, the fins positioned and spaced apart from one another to form channels, therebetween, the channels being positioned within the Stirling cycle based system to direct at least partial passage of the working fluid between the first heat exchanger and the second heat exchanger along a pathway other than along the first dimension to cause the working fluid to travel a longer distance in going between the first heat exchanger and the second heat exchanger than it would if the working fluid would travel entirely along the first dimension between the first heat exchanger and the second heat exchanger.

Other aspects include the regenerator having a plurality of fin layers, each fin layer having a plurality of fins positioned and spaced apart from one another to form channels, therebetween, the channels being positioned within the Stirling cycle based system to direct at least partial passage of the working fluid between the first heat exchanger and the second heat, and a plurality of insulation components, each insulation component having openings, each insulation component positioned between two different pairs of fin layers to align the openings of the insultation component with the channels of the fin layers to direct flow of working fluid between the channels of the fin layers, the insulation components having lower thermal conductances than the fin layers.

Other aspects include the regenerator having a plurality of fin layers, each fin layer having a plurality of fins positioned and spaced apart from one another to form channels, therebetween, the channels being positioned within the Stirling cycle based system to direct at least partial passage of the working fluid between the first heat exchanger and the second heat exchanger; a first of the fin layers having a fewer number of fins than a second of the fin layers, and a plurality of diffusers, each of the diffusers having passageways, each of the diffusers positioned between a pair of the fin layers to align the passageways of the diffuser with the channels of the fin layers to direct flow of working fluid between the fin layers of the pair.

Other aspects include the regenerator having a plurality of fin layers, each fin layer having a plurality of fins positioned and spaced apart from one another to form channels, therebetween, the channels being positioned within the Stirling cycle based system to direct at least partial passage of the working fluid between the first heat exchanger and the second heat; a first of the fin layers having a higher melting point than a second of the fin layers.

Other aspects include the regenerator being made by forming the regenerator from a plurality of material layers by micromachining to define passages shaped and positioned to direct flow of the working fluid through the passages between the first heat exchanger and the second heat exchanger. In some implementations forming the regenerator produces fins that define the passages.

Other aspects include a housing shaped to at least partially enclose an internal space from an external space, the internal space having a central axis, the external space containing the heat sink, and a heat exchanger positioned within the internal space of the housing, the heat exchanger having a pluraility of fins, each fin having a first end and a second end, the first end positioned closer to the central axis than the second end, each fin shaped to at least partially twist around the central axis, the second end of each fin being thermally coupled to the housing, the fins spaced apart to form channels, each channel configured to carry working fluid to transfer heat from the working fluid to the heat sink through the housing.

Other aspects inculde a housing shaped to at least partially enclose an internal space from an external space, the internal space having a central axis, the external space containing the heat source, and a heat exchanger having a first end and a second end, the heat exchanger positioned within the internal space of the housing with the distance along central axis from the first end and the second end of the heat exchanger being a first distance, the heat exchanger having a plurality of fins spaced apart to form channels, each of the channels shaped to provide a passage from the first end to the second end having a second distance longer distance than the first distance, each channel configured to carry working fluid.

Other aspects include a housing shaped to at least partially enclose an internal space from an external space, the internal space having a central axis, the external space containing the heat source, and a heat exchanger positioned within the internal space of the housing, the heat exchanger having a plurality of fins, each fin having a first end and a second end, the first end positioned closer to a central axis of the internal space than the second end and shaped to at least partially twist around the central axis, the second end of each fin being thermally coupled to the housing, the fins spaced apart to form channels, each channel configured to carry working fluid to transfer heat to the working fluid from the heat source through the housing.

Other aspects include a housing shaped to at least partially enclose an internal space from an external space, the internal space having a central axis, and a heat exchanger positioned within the internal space of the housing, the heat exchanger having a plurality of fins, each fin having a first end and a second end, the first end positioned closer to the central axis of the internal space than the second end, the second end of each fin being thermally coupled to the housing, portions of each fin closer to the second end than the first end of the fin being thicker than portions of the fin closer to the first end than the second end of the fin, the fins spaced apart to form channels, each channel configured to carry working fluid.

Other aspects include a housing shaped to at least partially enclose an internal space from an external space, the internal space having a central axis, and a heat exchanger positioned within the internal space of the housing, the heat exchanger having a plurality of fins, substantially along the direction of the central axis, each fin having a first thermally conductive layer, a second thermally conductive layer, and a thermally resistive layer therebetween, the fins spaced apart to form channels, each channel configured to carry working fluid.

Other aspects include a housing shaped to at least partially enclose an internal space from an external space, the internal space having a central axis, and a heat exchanger positioned within the internal space of the housing, the heat exchanger having a plurality of fins, substantially along the direction of the central axis, each fin having a first thermally conductive layer and second thermally conductive layer, the first thermally conductive layer having a high melting temperature than the second thermally conductive layer, the fins spaced apart to form channels, each channel configured to carry working fluid.

Other aspects include a housing shaped to at least partially enclose an internal space from an external space, the internal space having a central axis, the external space containing the heat source and the heat sink, a first heat exchanger having a plurality of fins, each fin having a first end and a second end, the first end positioned closer to the central axis than the second end, the second end of each fin being thermally coupled to the housing, the fins spaced apart to form channels, each channel configured to carry working fluid to transfer heat to the working fluid from the heat source through the housing, a second heat exchanger having a plurality of fins, each fin having a first end and a second end, the first end positioned closer to the central axis than the second end and shaped to at least partially twist around the central axis, the second end of each fin being thermally coupled to the housing, the fins spaced apart to form channels, each channel configured to carry working fluid to transfer heat from the working fluid to the heat sink through the housing, and a regenerator having a plurality of fins spaced apart to form channels, the regenerator positioned between the first heat exchanger and the second heat exchanger along the central axis to couple the channels of first heat exchanger with the channels of the regenerator and to couple the channels of the regenerator with the channels of the second heat exchanger.

Other aspects include a monolithic structure having a housing shaped to at least partially enclose an internal space from an external space, the internal space having a central axis, the external space containing the heat source and the heat sink, a first heat exchanger having a plurality of fins, each fin having a first end and a second end, the first end positioned closer to the central axis than the second end, the second end of each fin being thermally coupled to the housing, the fins spaced apart to form channels, each channel configured to carry working fluid to transfer heat to the working fluid from the heat source through the housing, a second heat exchanger having a plurality of fins, each fin having a first end and a second end, the first end positioned closer to the central axis than the second end and shaped to at least partially twist around the central axis, the second end of each fin being thermally coupled to the housing, the fins spaced apart to form channels, each channel configured to carry working fluid to transfer heat from the working fluid to the heat sink through the housing, and a regenerator having fins spaced apart to form channels, the regenerator positioned between the first heat exchanger and the second heat exchanger along the central axis to couple the channels of first heat exchanger with the channels of the regenerator and to couple the channels of the regenerator with the channels of the second heat exchanger, the housing, the first heat exchanger, the second heat exchanger, and the regenerator being integral components of the monolithic structure.

Other aspects include a housing shaped to at least partially enclose an internal space from an external space, the internal space having a central axis, the external space containing the heat source and the heat sink, a first heat exchanger having a plurality of fins, each fin having a first end and a second end, the first end positioned closer to the central axis than the second end, the second end of each fin being thermally coupled to the housing, the fins spaced apart to form channels, each channel configured to carry working fluid to transfer heat to the working fluid from the heat source through the housing, a second heat exchanger having a plurality of fins, each fin having a first end and a second end, the first end positioned closer to the central axis than the second end and shaped to at least partially twist around the central axis, the second end of each fin being thermally coupled to the housing, the fins spaced apart to form channels, each channel configured to carry working fluid to transfer heat from the working fluid to the heat sink through the housing, a regenerator having a plurality of fins spaced apart to from channels, the regenerator positioned between the first heat exchanger and the second heat exchanger along the central axis to couple the channels of first heat exchanger with the channels of the regenerator and to couple the channels of the regenerator with the channels of the second heat exchanger, and a plurality of diffusers, at least one of the diffusers positioned between the first heat exchanger and the regenerator and having passageways positioned on the diffuser to direct fllow of working fluid between the channels of the first heat exchanger and the channels of the regenerator and at least one of the diffusers positioned between the regenerator and the second heat exchanger and having passageways positioned on the diffuser to direct flow of working fluid between the channels of the regenerator and the channels of the second heat exchanger.

Other aspects include a housing shaped to at least partially enclose an internal space from an external space, a heat exchanger positioned in the internal space, the heat exchanger having fins, each fin being thermally coupled to the housing, the fins spaced apart to form channels, each channel configured to carry working fluid, the heat exchanger having a thermal conductivity, a regenerator having a plurality of fins spaced apart to form channels, the regenerator having a thermal conductivity, and an insulation component having a thermal conductivity smaller than the thermal conductivity of the heat exchanger and smaller than the thermal conductivity of the regenerator, the insulation component positioned between the heat exchanger and the regenerator, the insulation component having openings in alignment with the channels of the heat exchanger and the channels of the regenerator to allow for flow of working fluid between the heat exchanger and the regenerator.

Other aspects include making a housing, a first heat exchanger to transfer heat from a heat source external to the housing to a working fluid internal to the housing, a second heat exchanger to transfer heat from the working fluid to a heat sink external to the housing, and a regenerator positioned to contact a portion of the working fluid as the working fluid moves between the first heat exchanger and the second heat exchanger by forming the housing, the first heat exchanger, the second heat exchanger, and the regenerator from a plurality of material layers by micromachining to define the housing, the first heat exchanger, the second heat exchanger, and the regenerator by in part defining shape, size, and positioning of passages for the first heat exchanger, the second heat exchanger, and the regenerator to direct flow of working fluid through the passages. In some implementations forming produces fins that define the passages. In other implementations forming produces the housing, the first heat exchanger, the second heat exchanger, and the regenerator as a single structural unit.

Other features and advantages of the invention will become apparent from the following detailed description, taken in conjunction with the accompanying drawings.

BRIEF DESCRIPTION OF THE SEVERAL VIEWS OF THE DRAWING(S)

Figure 6:
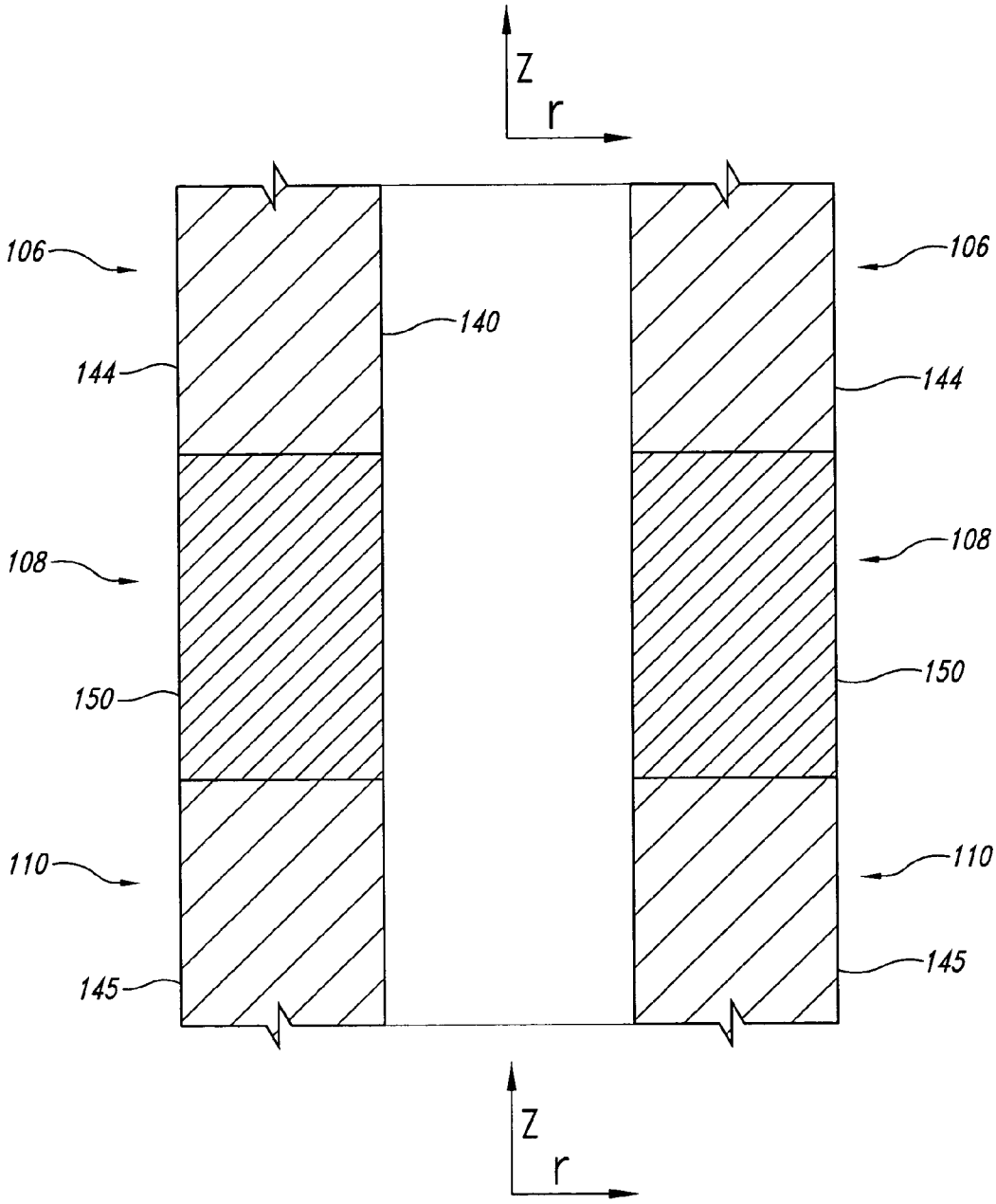
FIG. 6 is cross-sectional schematic of a portion of a channelized stratified regenerator implemented as a swept fin regenerator and of portions of two heat exchangers integrated with this swept fin regenerator.
Figure 6A:
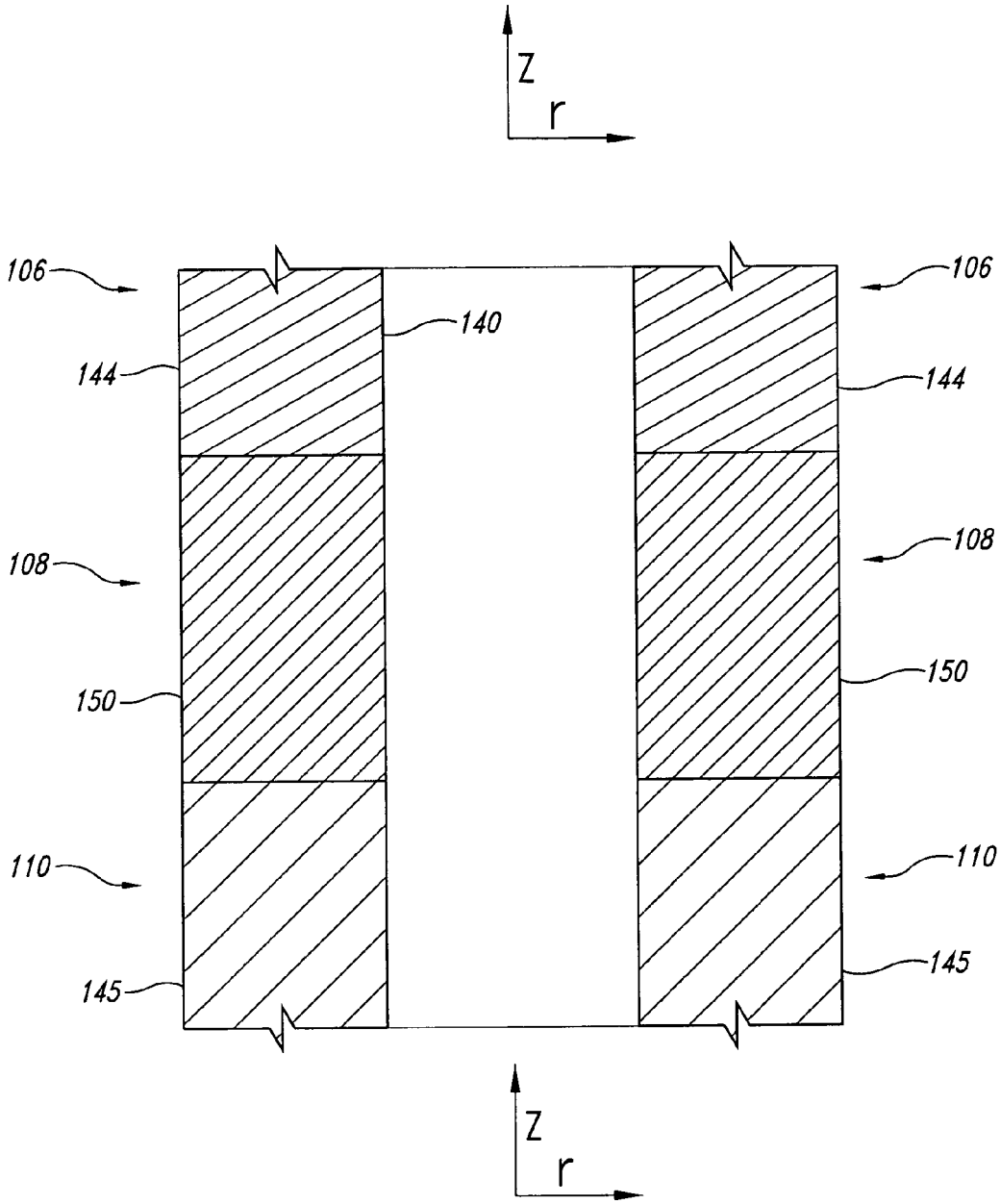
FIG. 6A is cross-sectional schematic of a portion of a channelized stratified regenerator implemented as a swept fin regenerator and of portions of two heat exchangers integrated with this swept fin regenerator in which associated fin spacing, associated fin pitch, and exchanger height of the two heat exchangers varies.
Figure 6B:
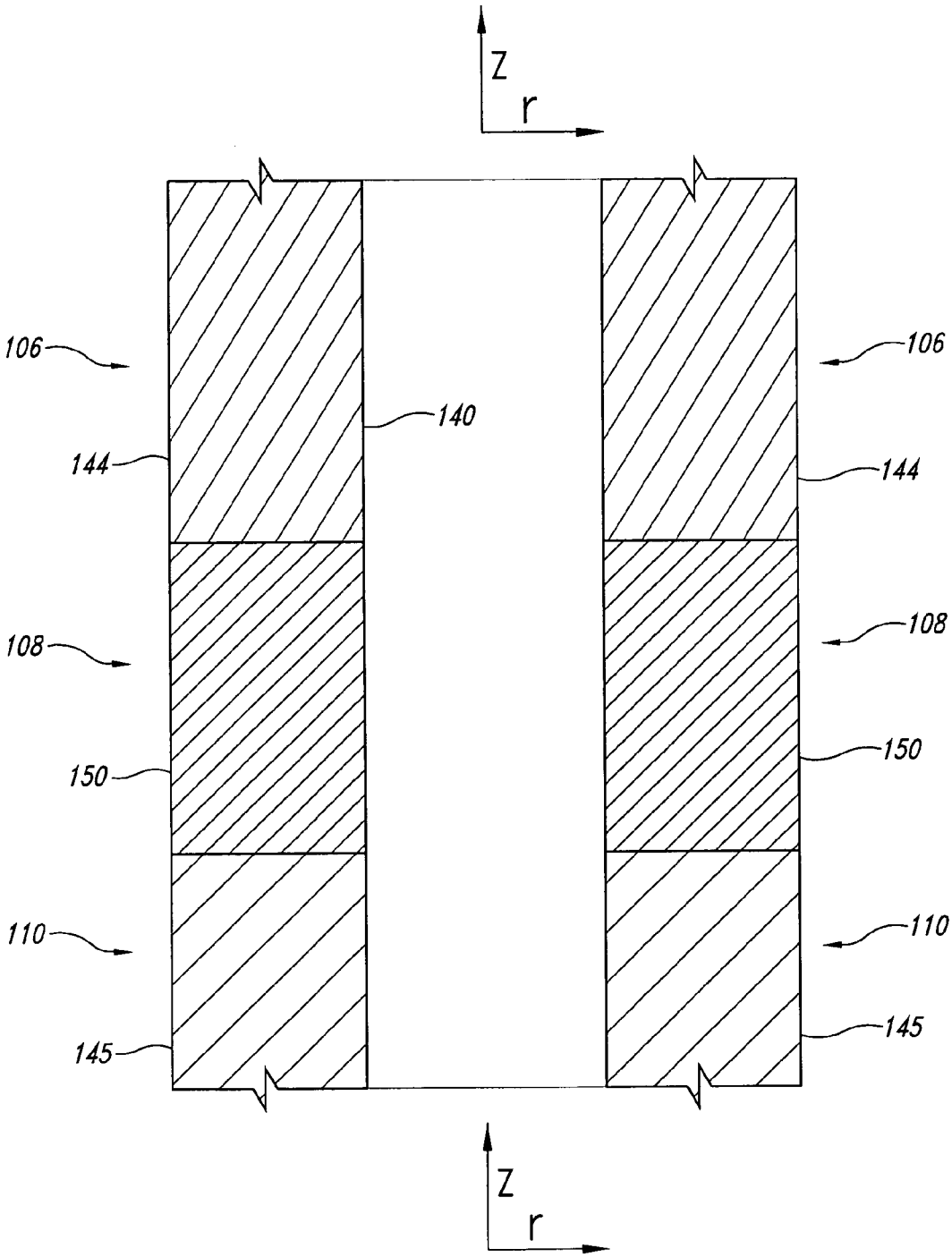
FIG. 6B is cross-sectional schematic of a portion of a channelized stratified regenerator implemented as a swept fin regenerator and of portions of two heat exchangers integrated with this swept fin regenerator in which associated fin spacing, associated fin pitch, and exchanger height of the two heat exchangers varies.
Figure 6C:
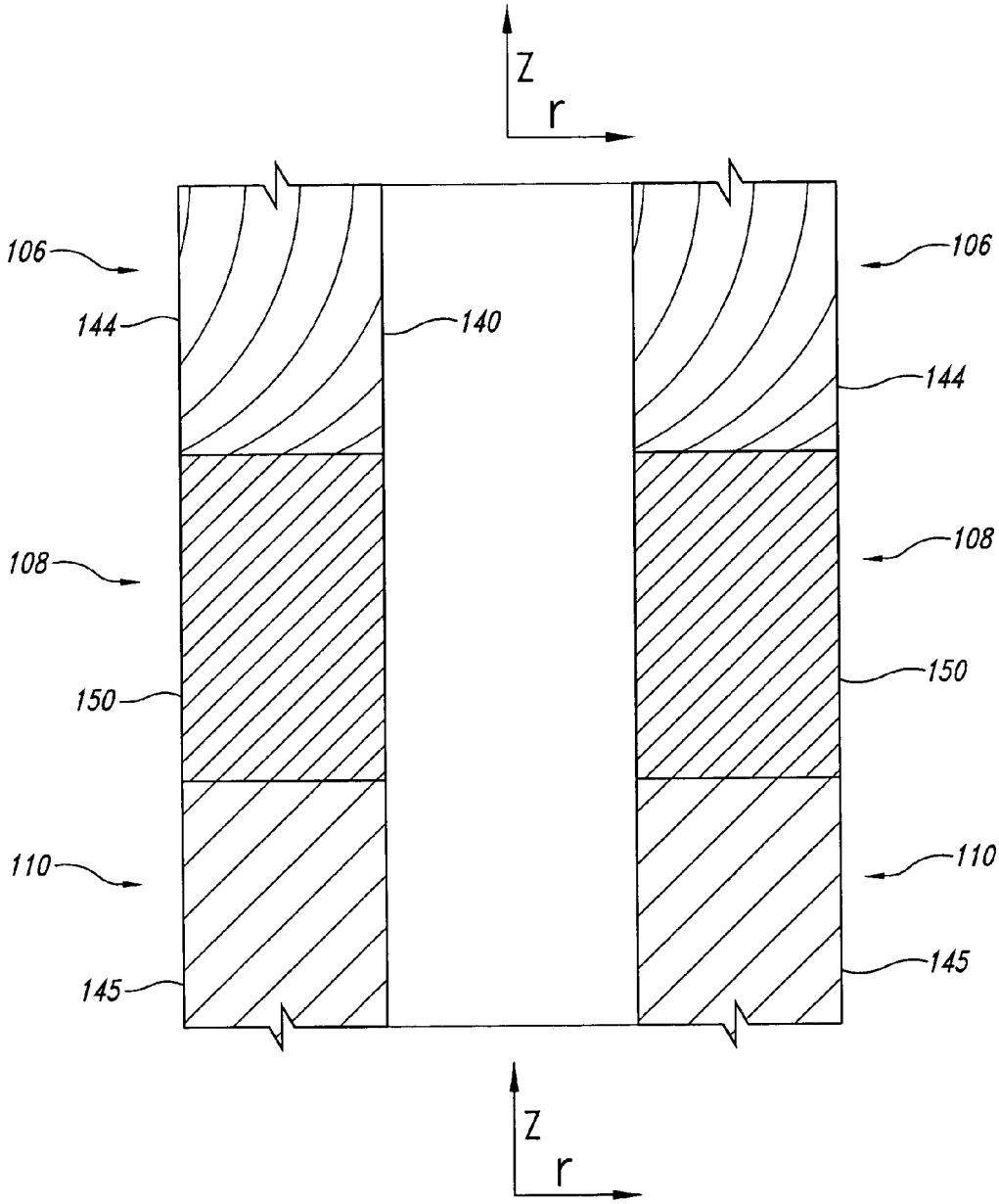
Figure 7:
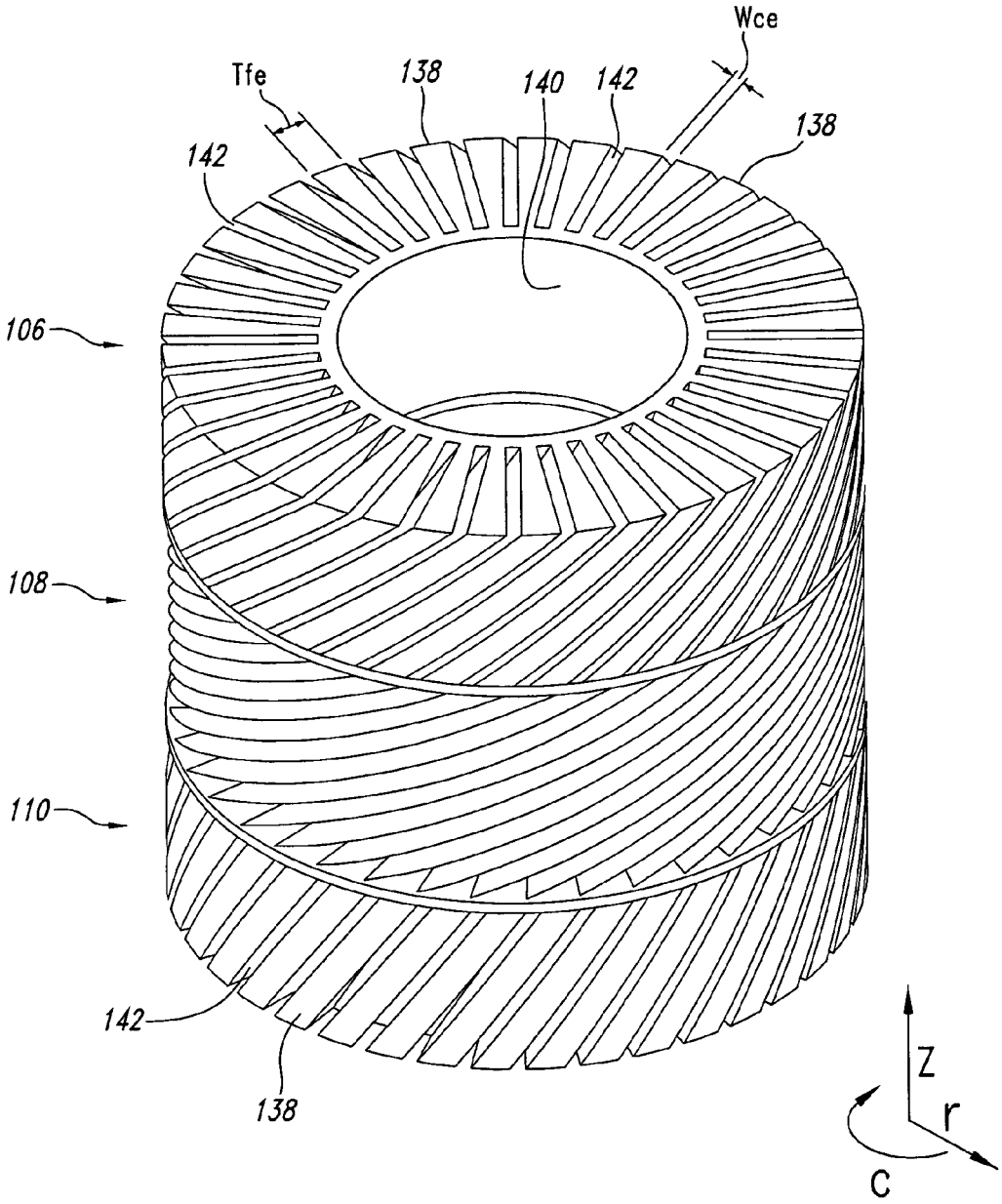

FIG. 6C is cross-sectional schematic of a portion of a channelized stratified regenerator implemented as a swept fin regenerator and of portions of two heat exchangers integrated with this swept fin regenerator in which associated fin spacing, associated fin pitch, and exchanger height of the two heat exchangers varies wherein the acceptor of the two heat exchangers has curved fin pitch. FIG. 7 is an isometric view of the portion of the swept fin regenerator and integrated heat exchangers of FIG. 6.

Figure 8:
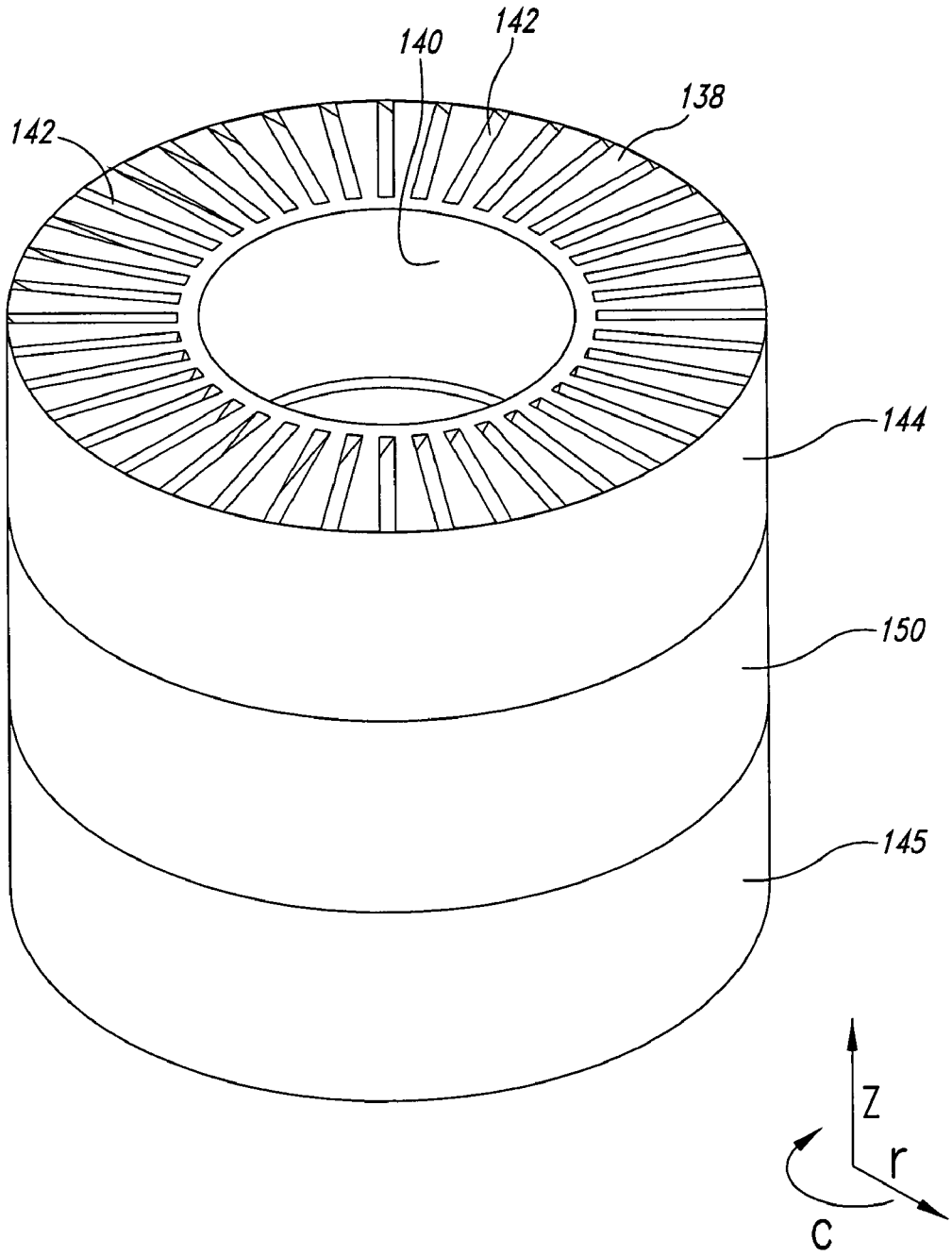

FIG. 8 is an isometric view of the portion of the swept fin regenerator and integrated heat exchangers of FIG. 7 with exterior and interior walls shown.

Figure 9:
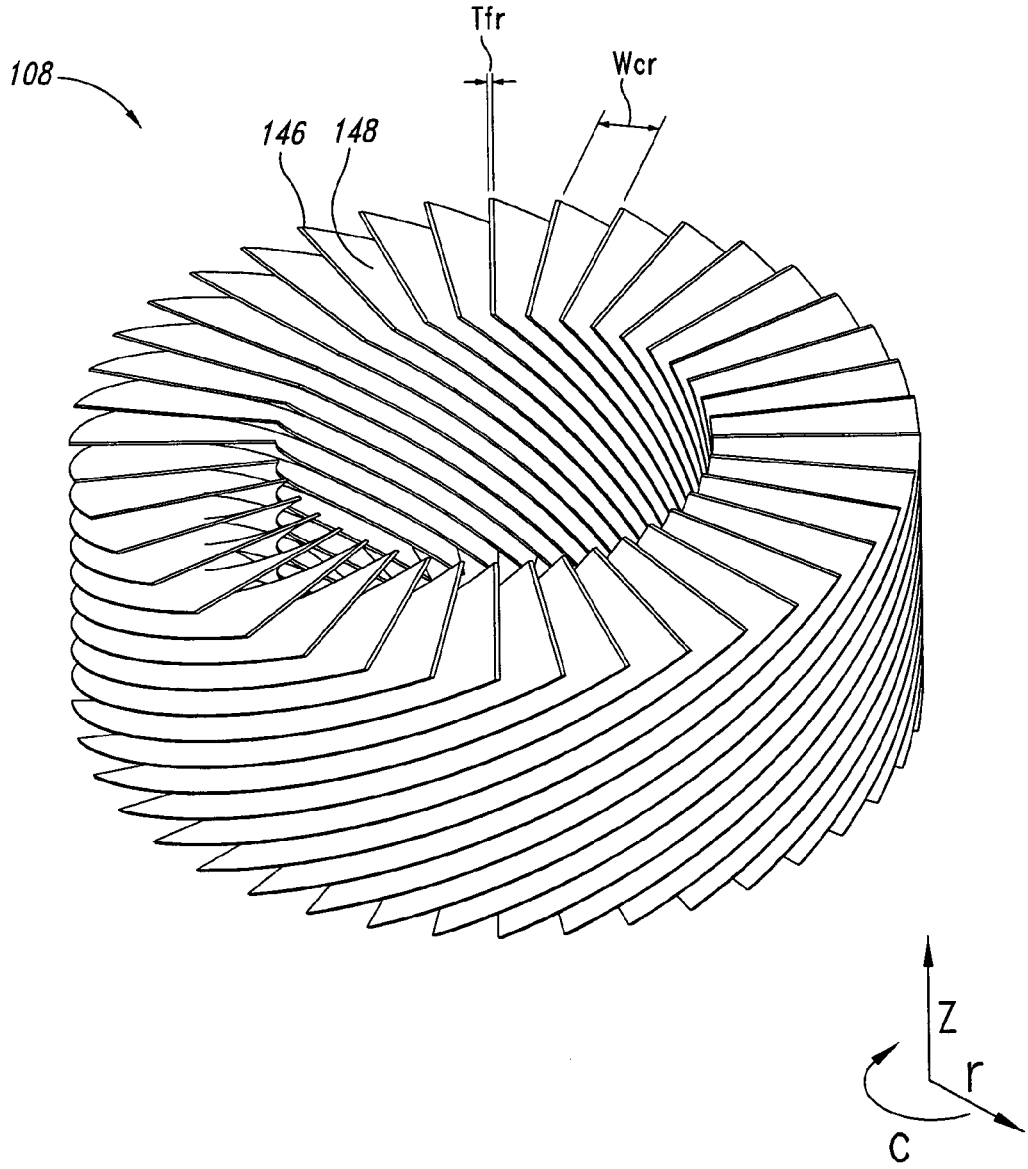

FIG. 9 is an isometric view of the swept fin regenerator of FIG. 7 with the integrated heat exchangers removed.

Figure 10:
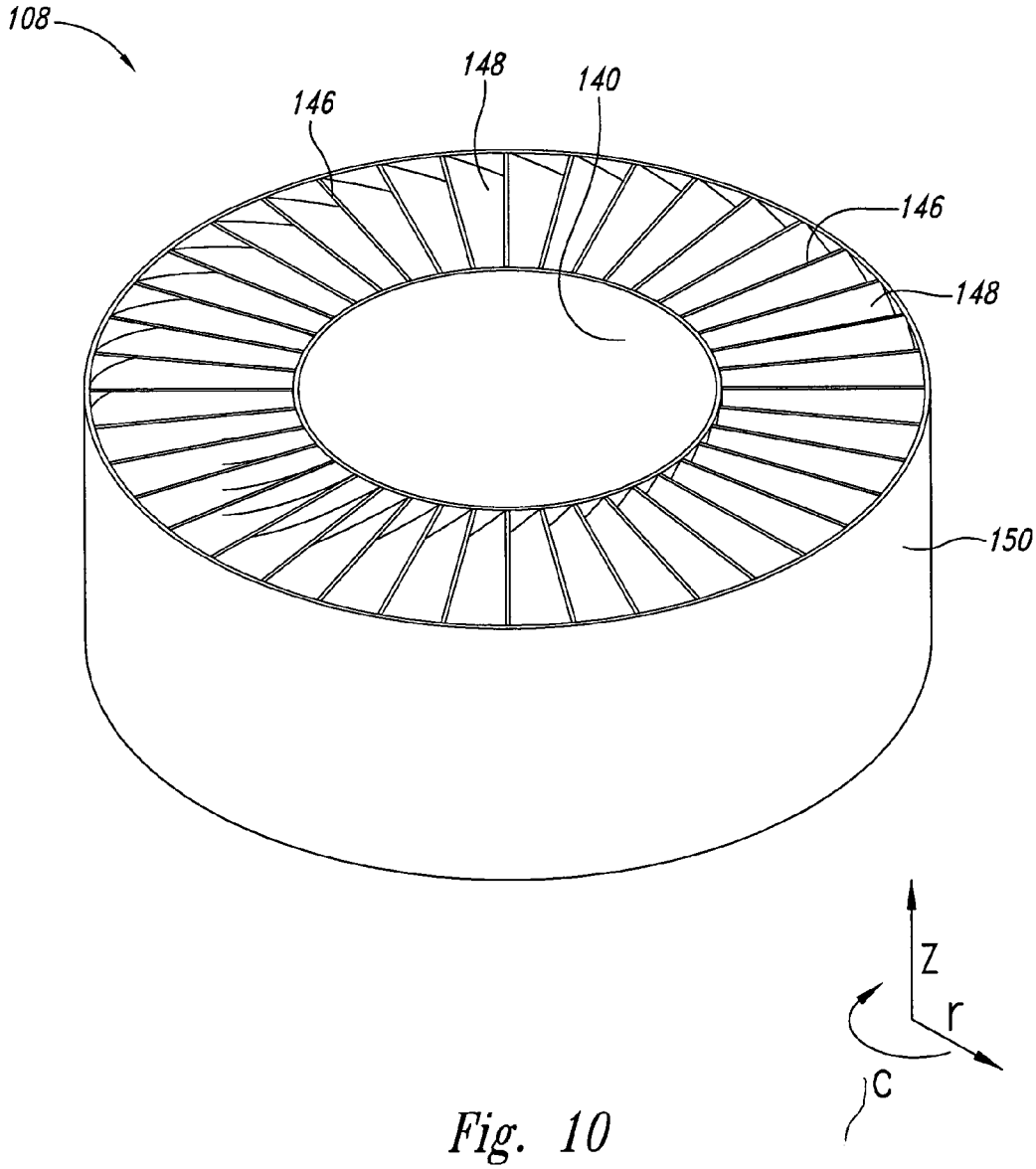

FIG. 10 is an isometric view of the swept fin regenerator of FIG. 8 with the integrated heat exchangers removed.

Figure 5:
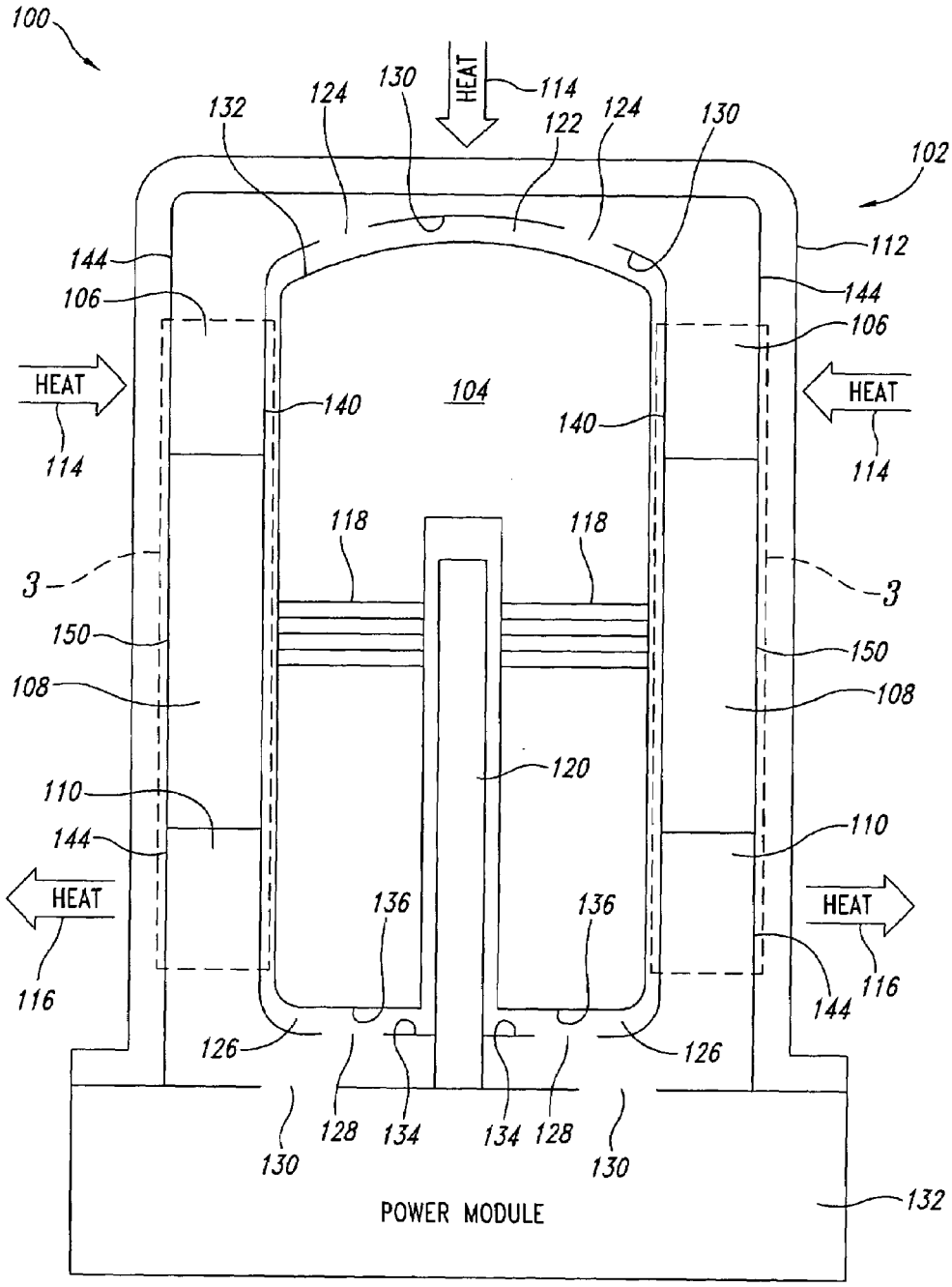
FIG. 5 is a cross-sectional schematic of an enhanced thermal assembly coupled with a conventional power module showing placement of a channelized stratified regenerator and integrated heat exchangers.
Figure 11:
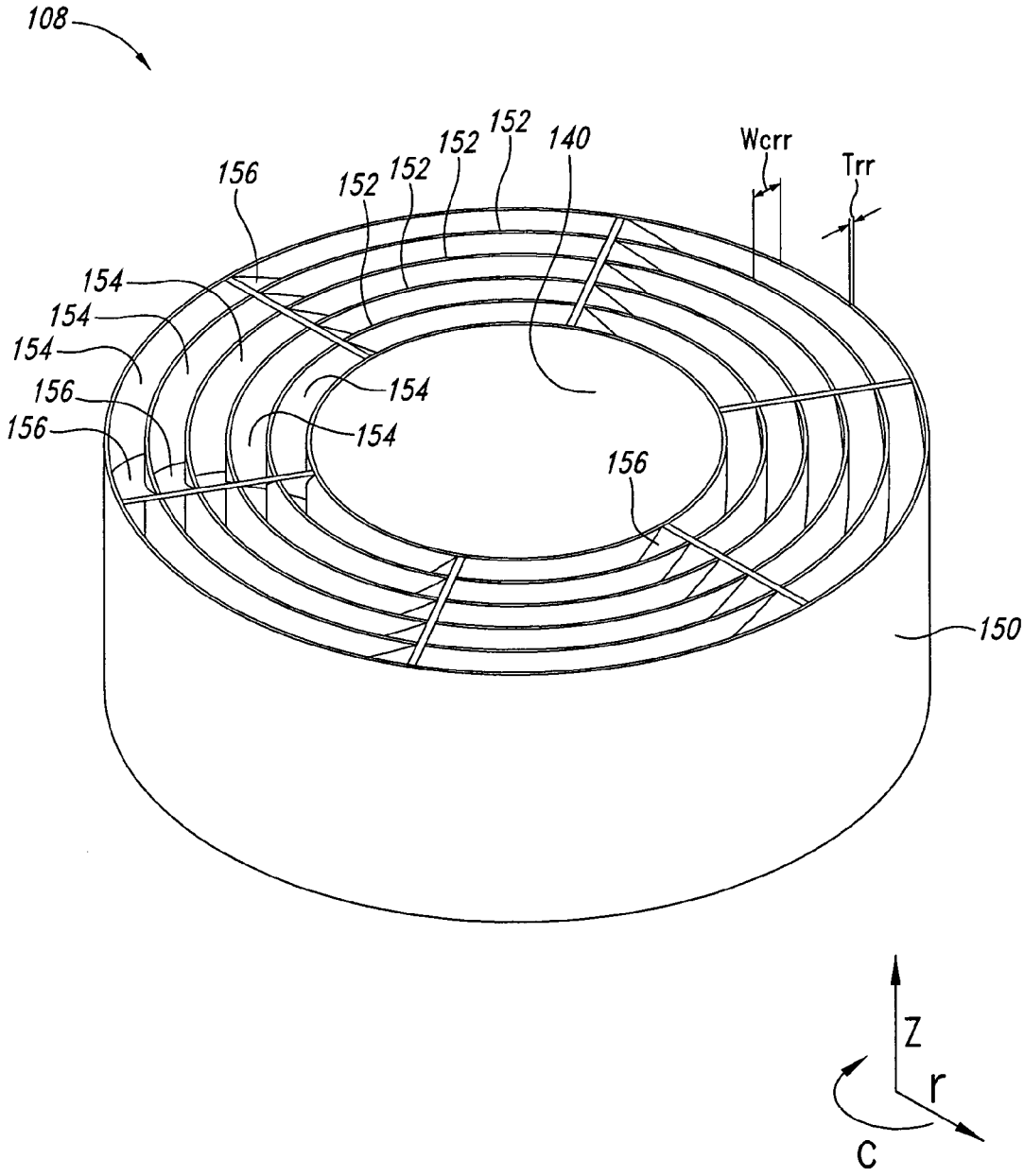

FIG. 11 is an isometric view of the channelized stratified regenerator of FIG. 5 implemented as an annular regenerator with the swept spacers.

Figure 12:
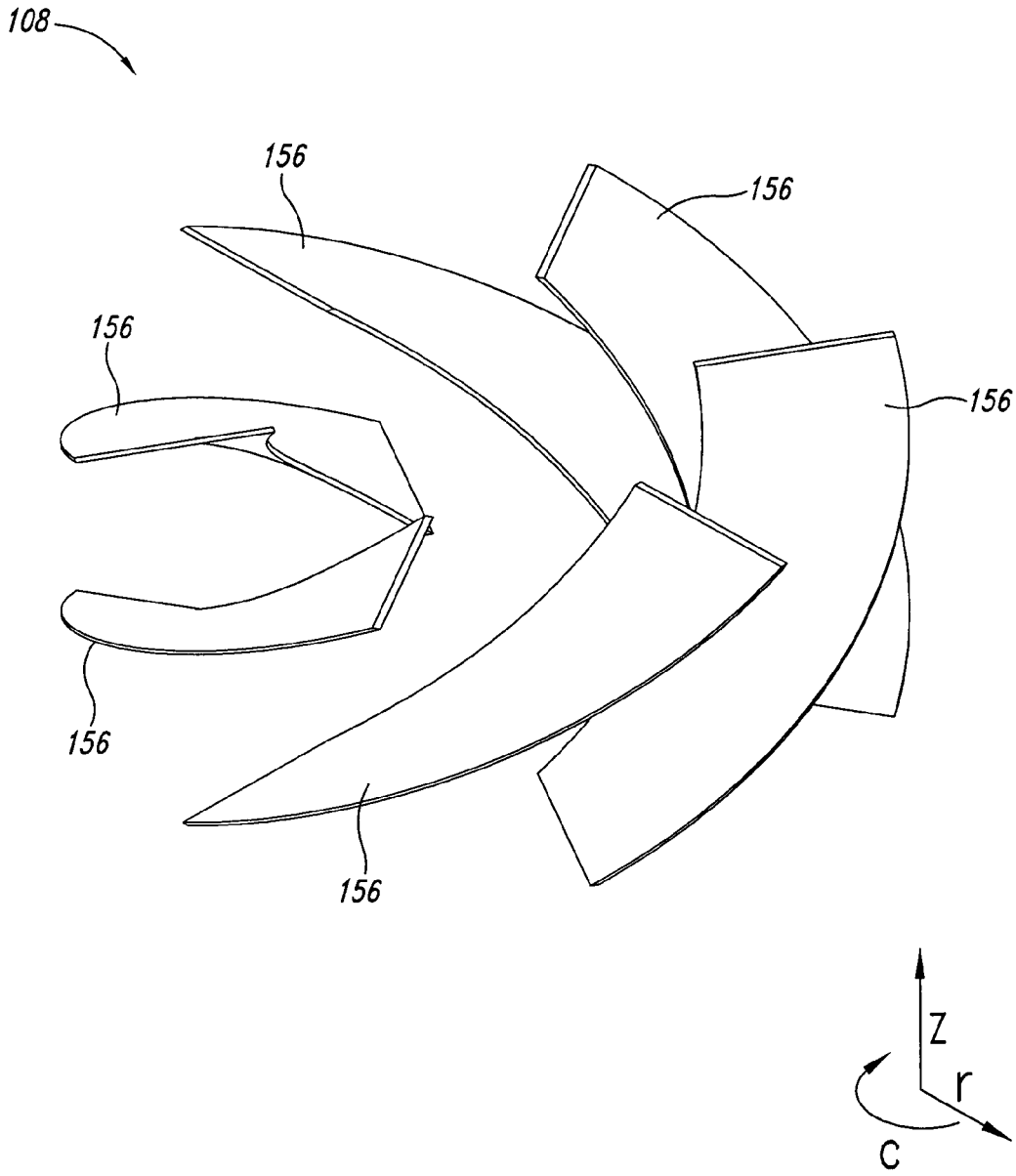

FIG. 12 is an isometric view of the swept spacers of FIG. 11.

Figure 13:
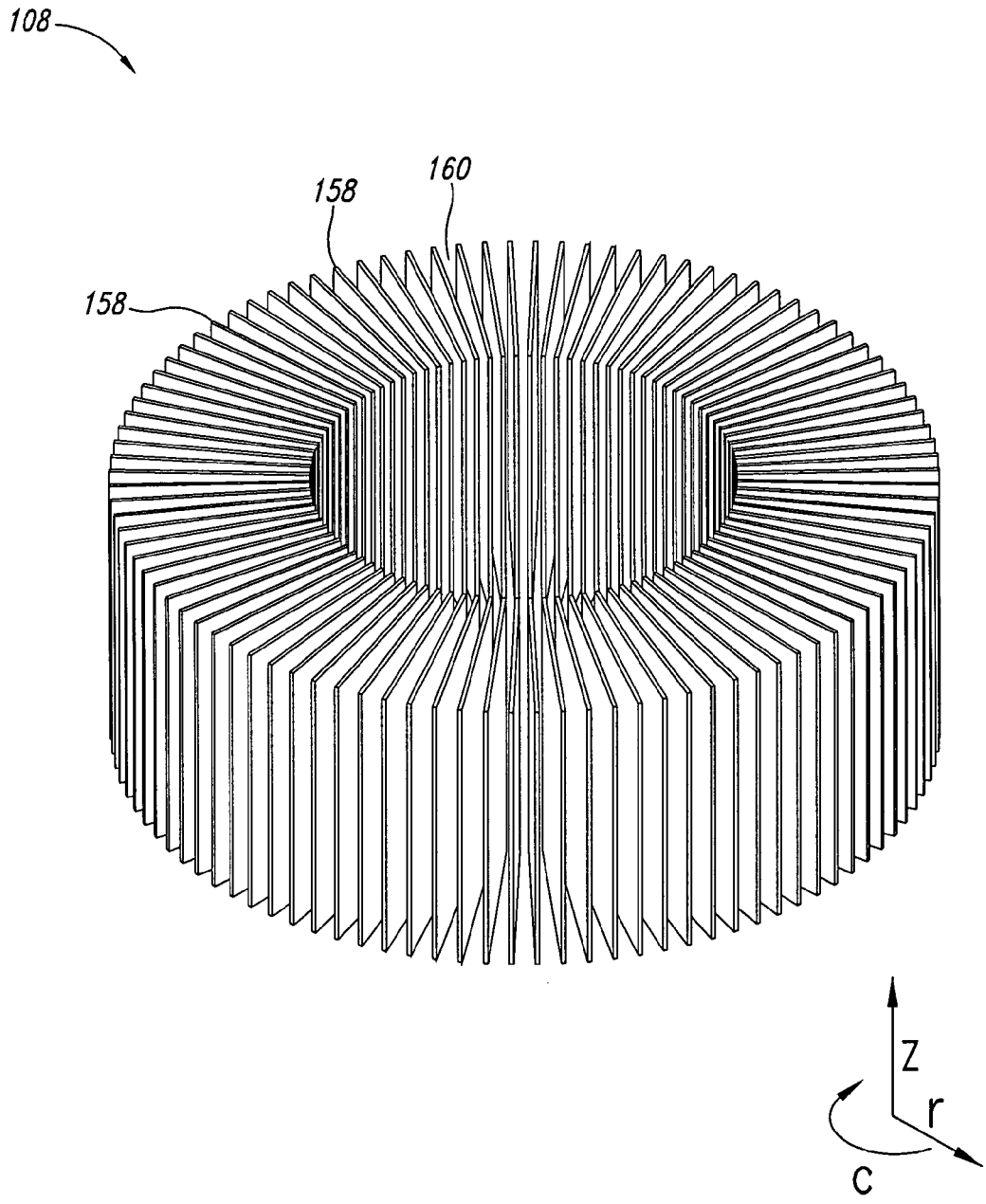

FIG. 13 is an isometric view of the channelized stratified regenerator of FIG. 5 implemented as a radial regenerator.

Figure 14:
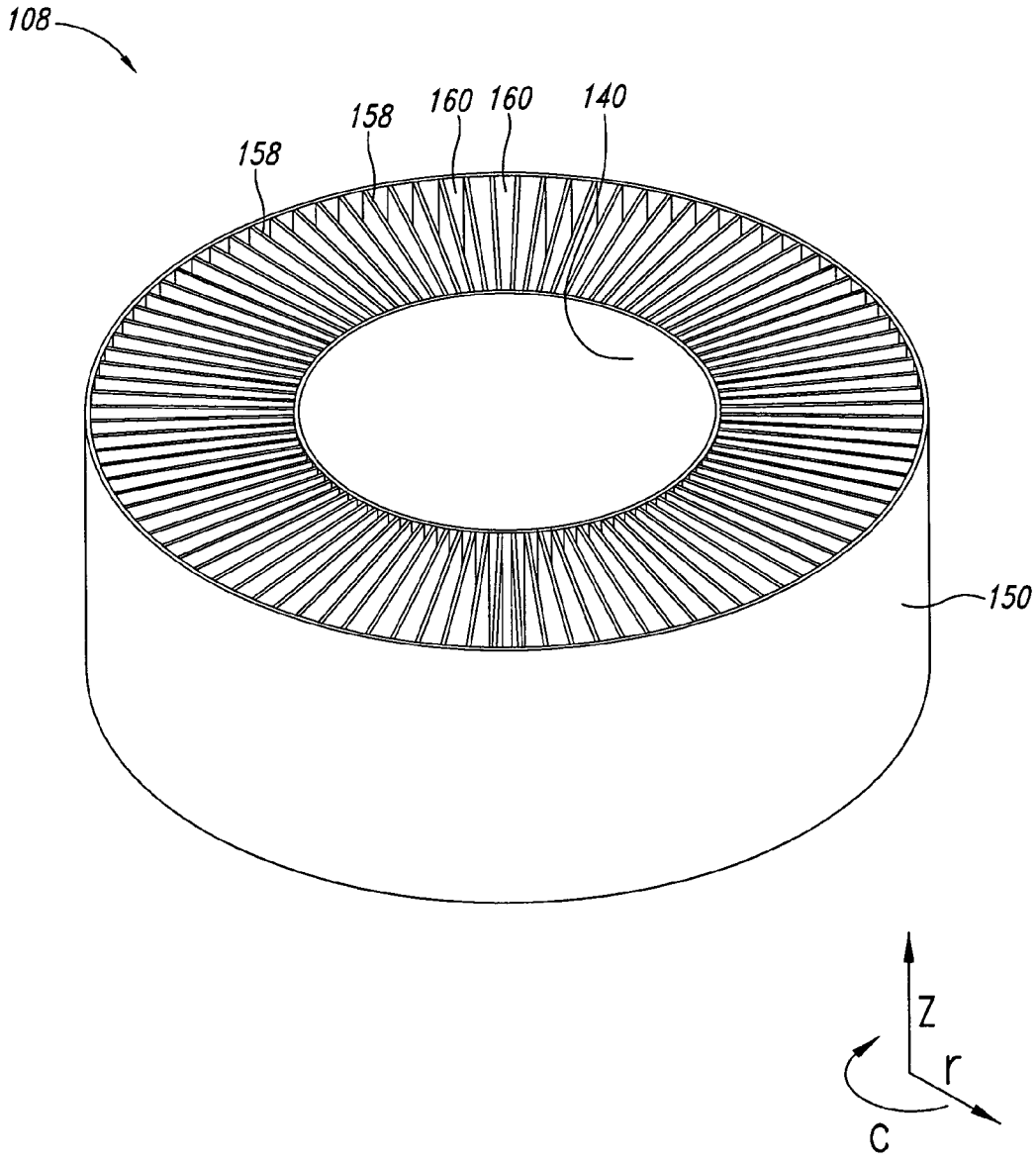

FIG. 14 is an isometric view of the radial regenerator of FIG. 10 with exterior and interior walls shown.

Figure 15:
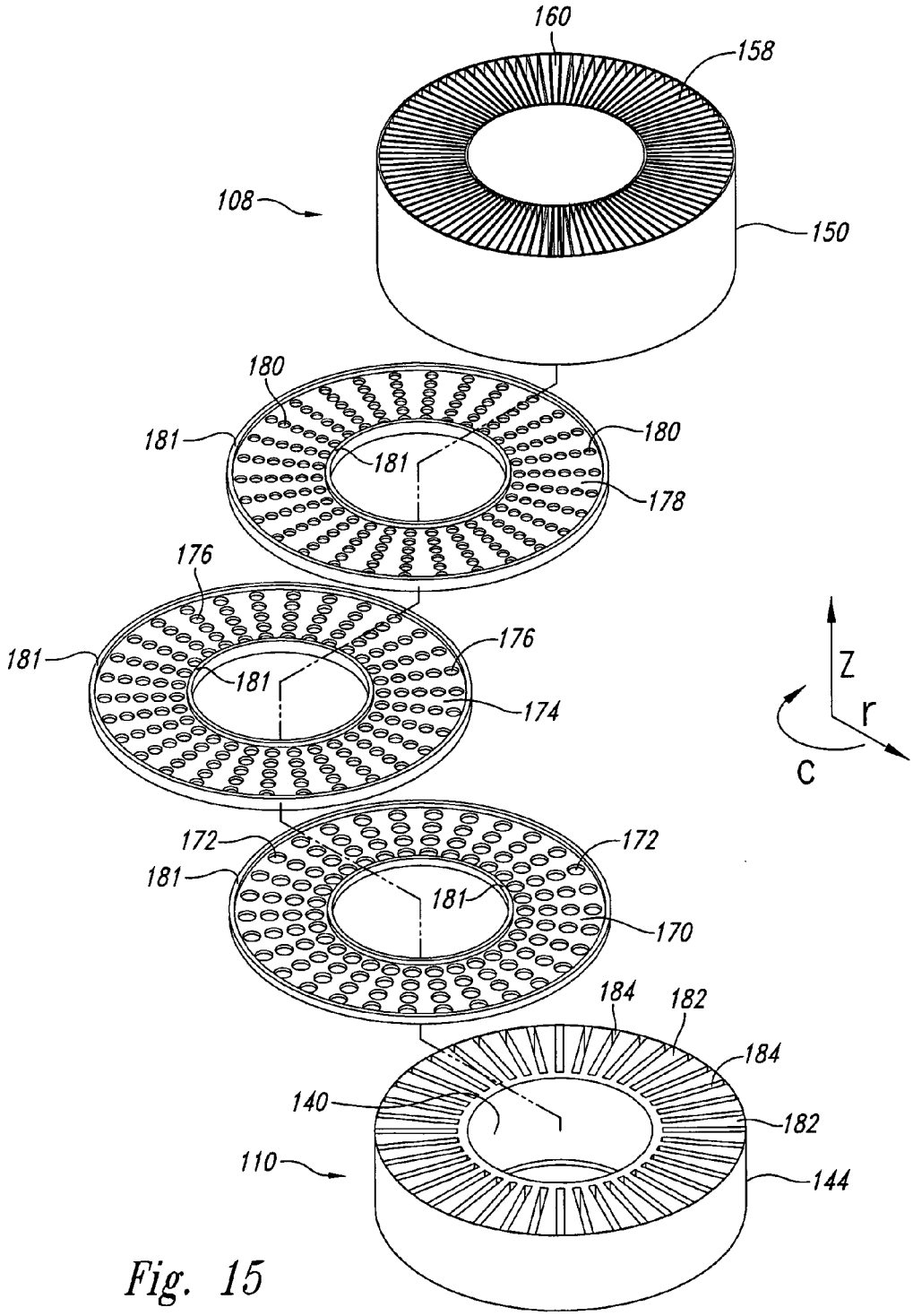

FIG. 15 is an isometric exploded view of the radial regenerator of FIG. 14 along with a radial heat exchanger and a set of stacked diffusers for integration of the radial regenerator with the radial heat exchanger.

FIG. 16 is an isometric view of the radial regenerator, the stacked diffusers, and the radial heat exchanger of FIG. 15.

Figure 17:
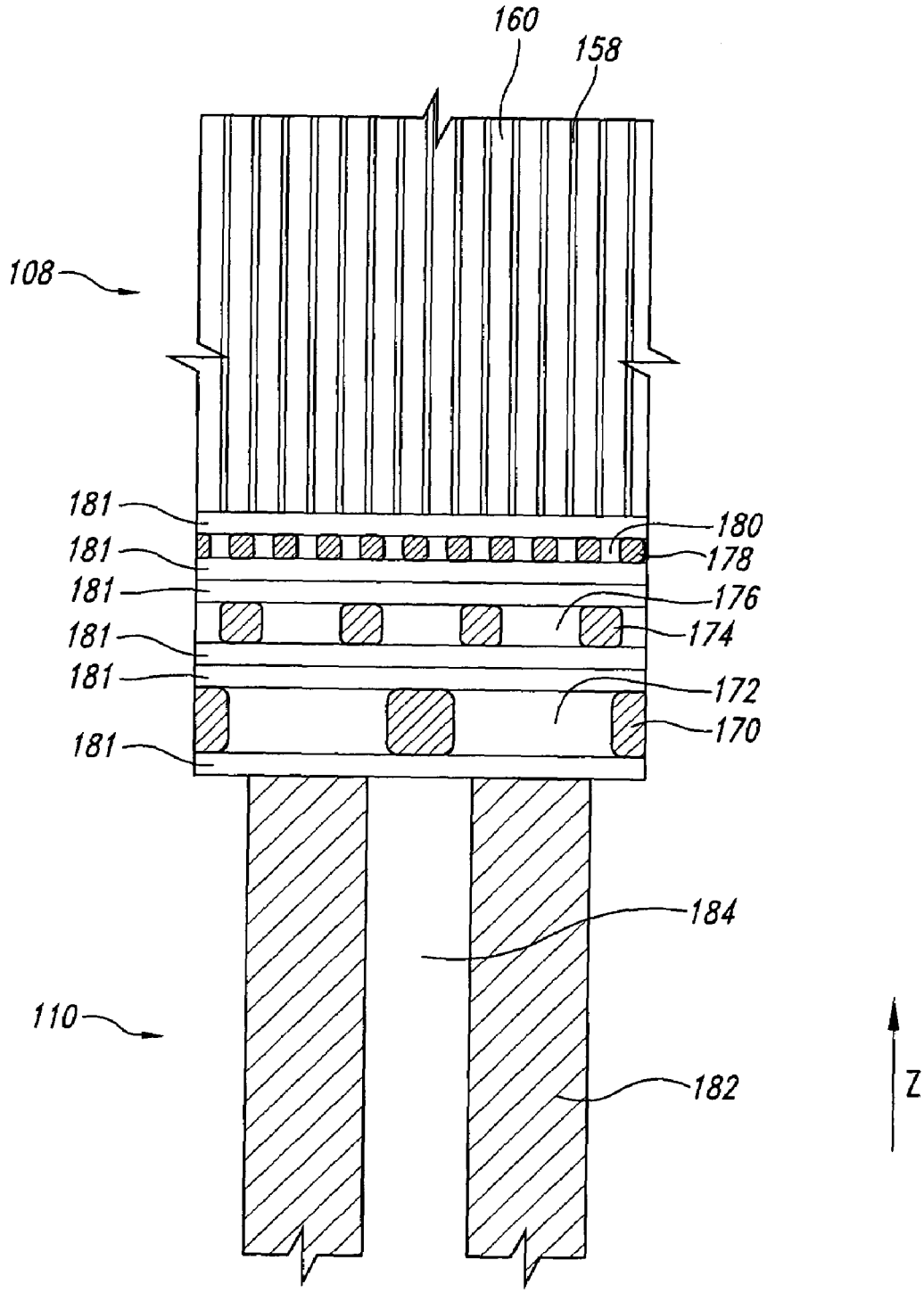

FIG. 17 is a cross-sectional view of portions of the radial regenerator, the stacked diffusers, and the radial heat exchanger of FIG. 16.

Figure 17A:
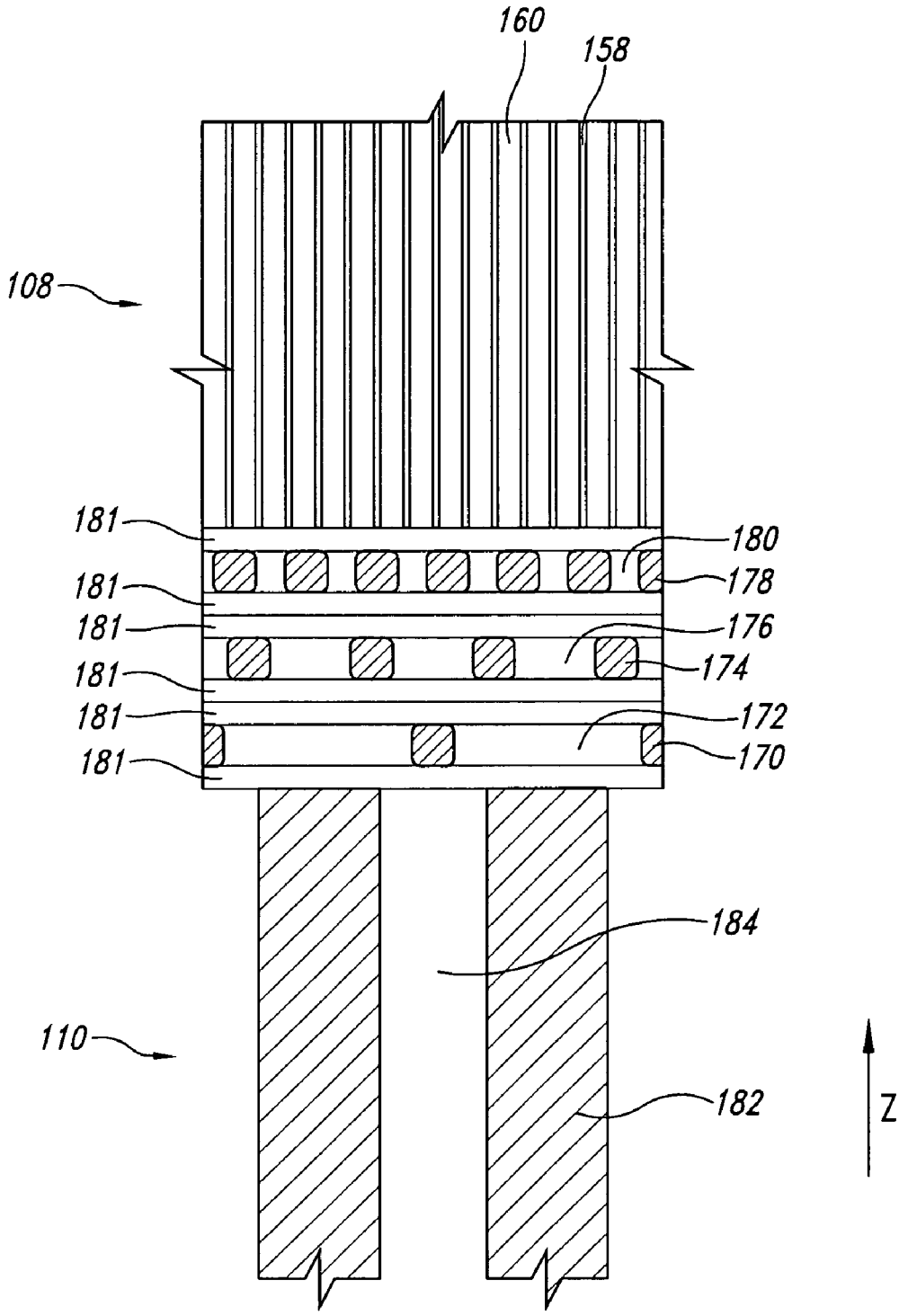

FIG. 17A is a cross-sectional view of portions of the radial regenerator, the stacked diffusers, and the radial heat exchanger in dimensional height of the spacers are kept constant.

Figure 18:
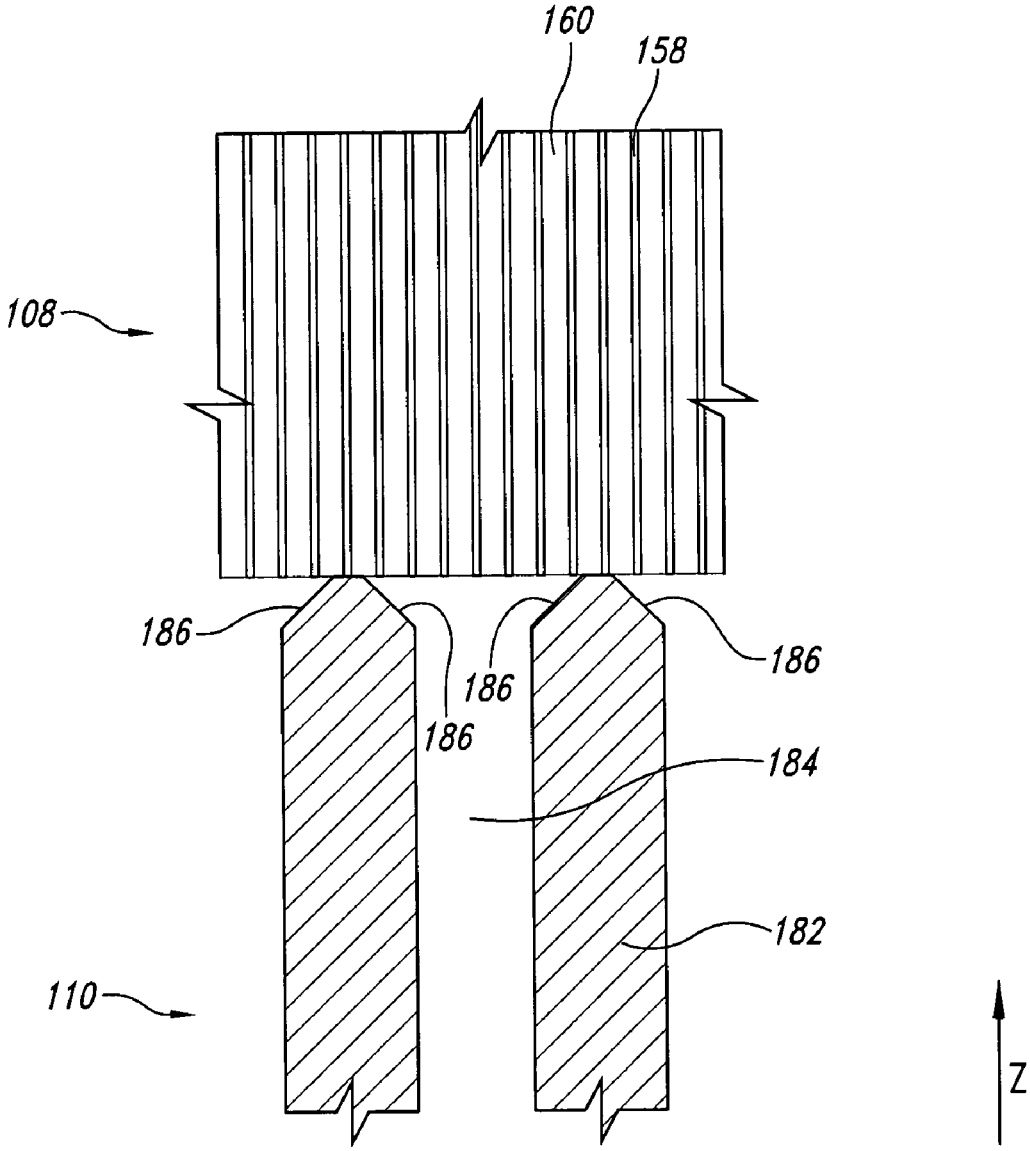

FIG. 18 is a cross-sectional view of the radial regenerator with an alternative implementation of the radial heat exchanger having chamfers.

Figure 19:
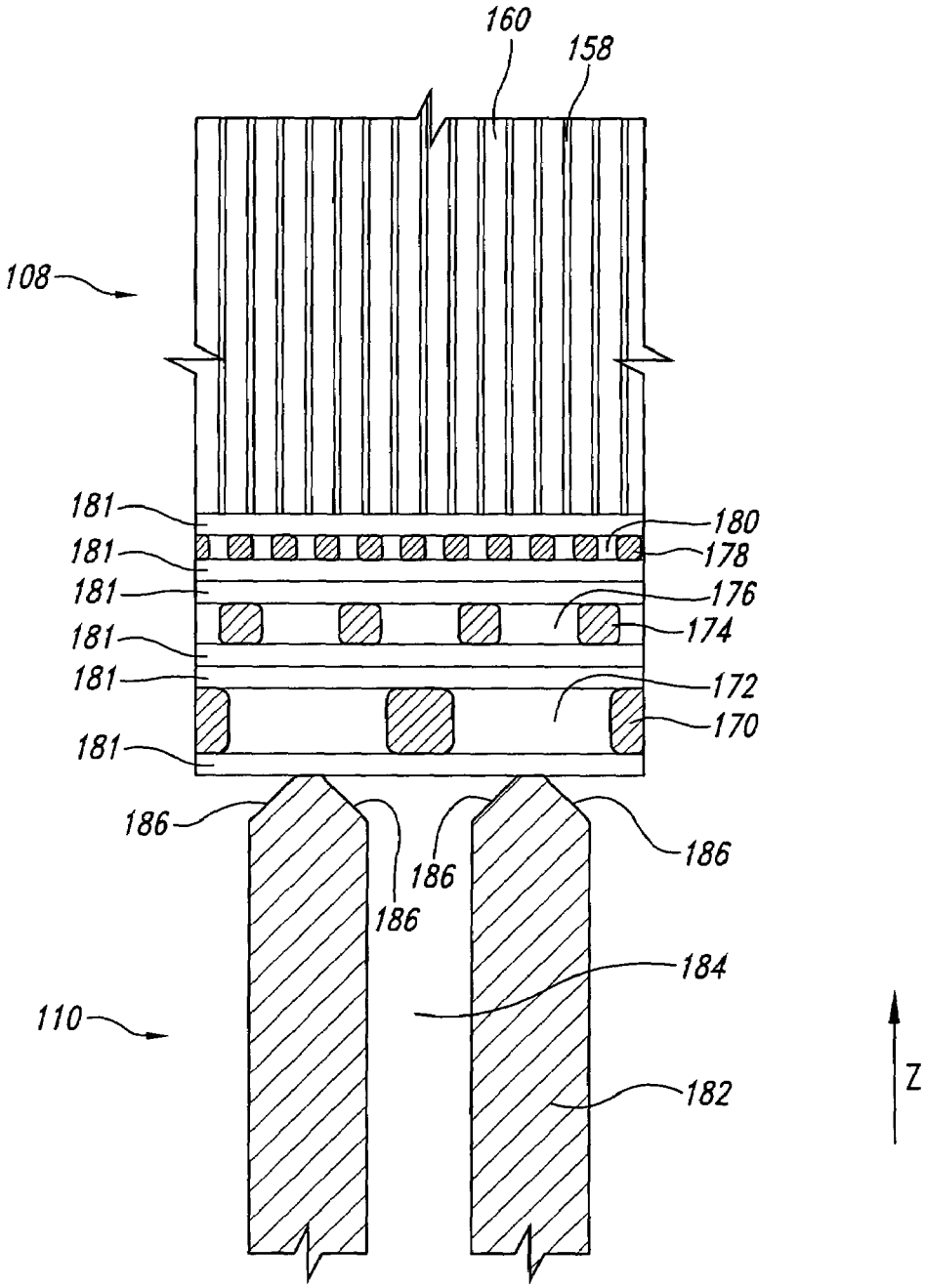

FIG. 19 is a cross-sectional view of the radial regenerator, the stacked diffusers, and the radial heat exchangers with chamfers.

Figure 20:
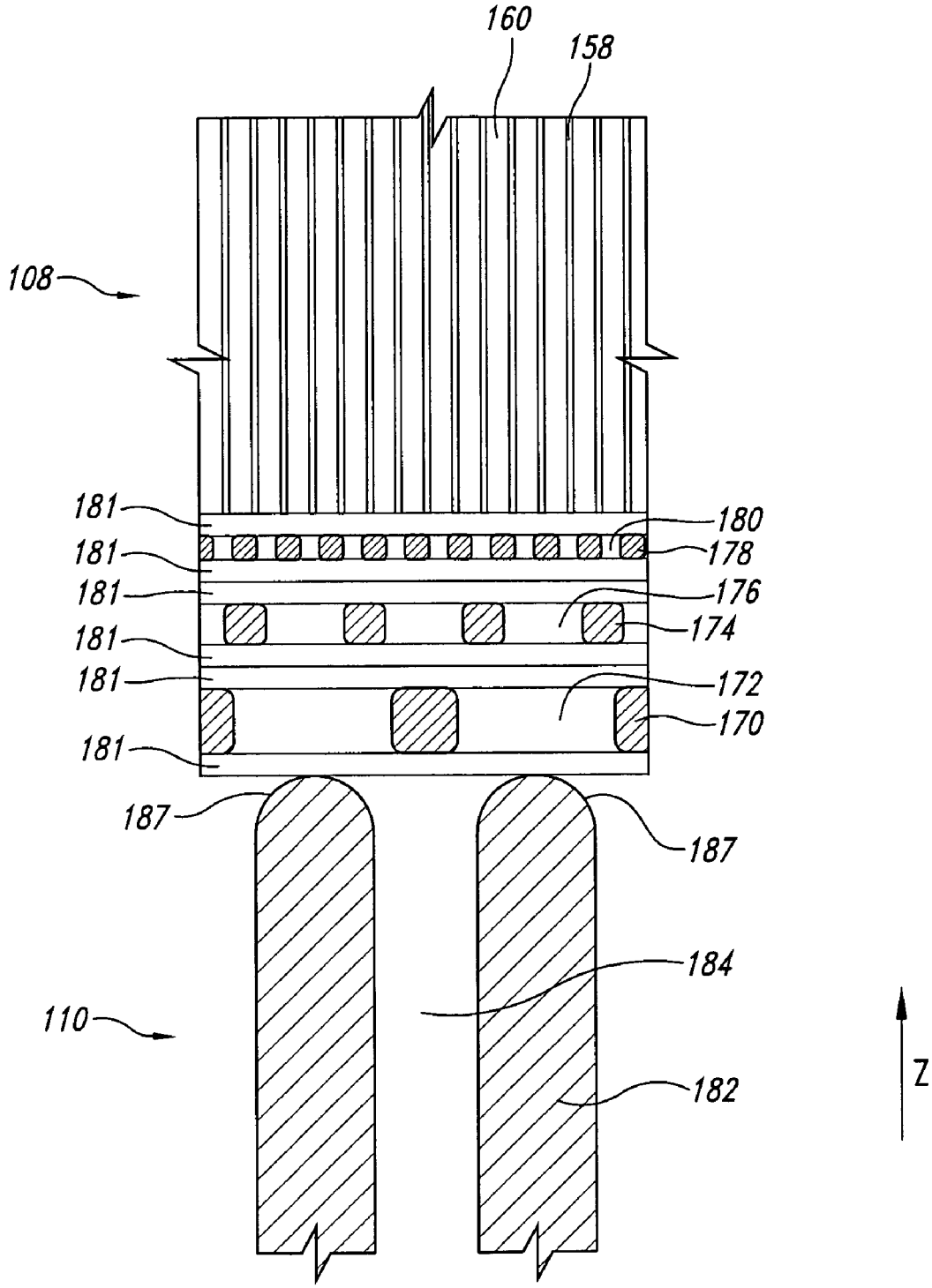

FIG. 20 is a cross-sectional view of the radial regenerator, the stacked diffusers, and the radial heat exchangers with radiused ends.

Figure 21:
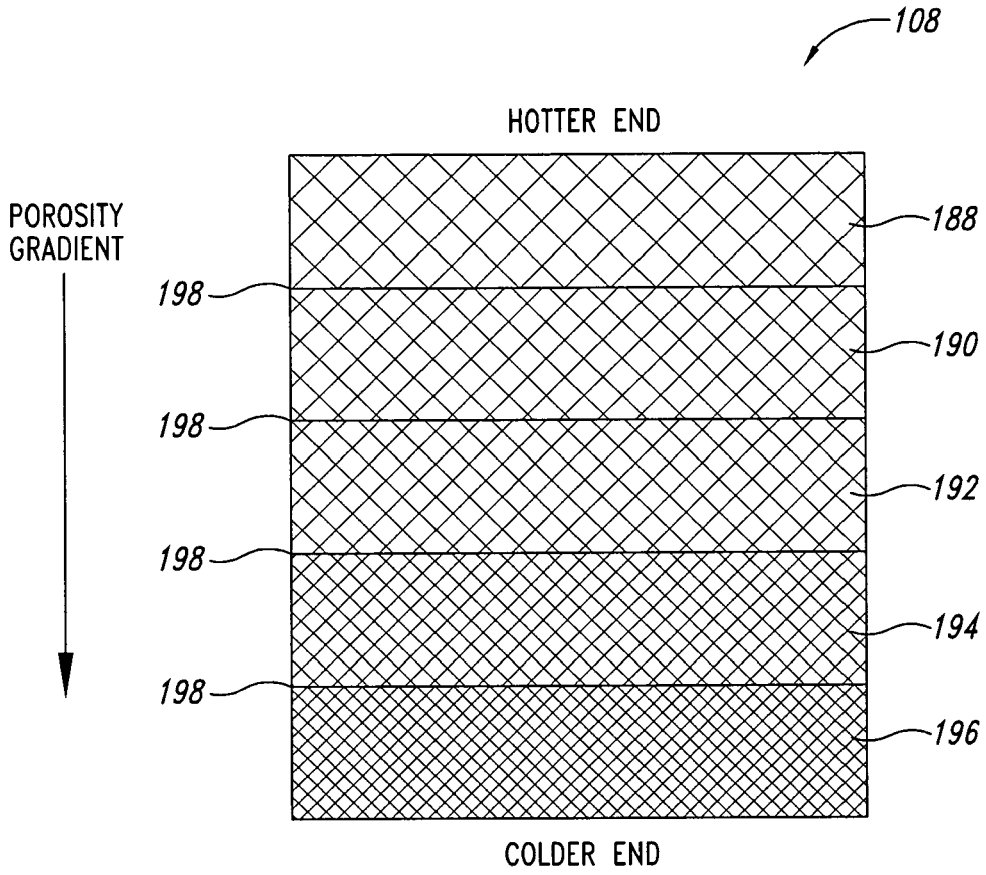

FIG. 21 is a cross-sectional schematic of an implementation of the stratified channelized regenerator of FIG. 5 with a porosity gradient, tailored material layers, and interspersed insulation layers.

Figure 22:
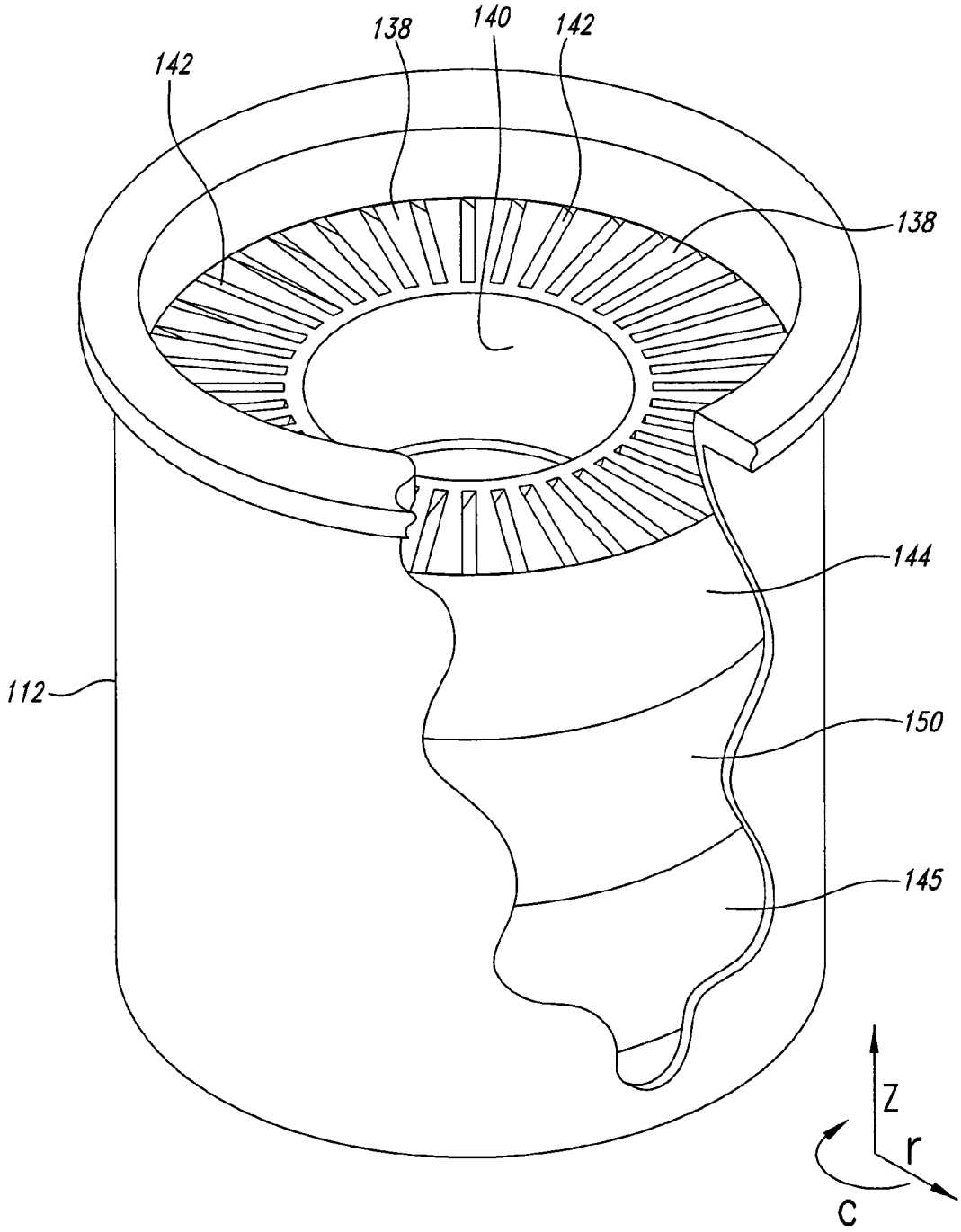

FIG. 22 is an isometric view of the stratified channelized regenerator with integrated heat exchangers shown brazed to a pressure vessel.

Figure 23:
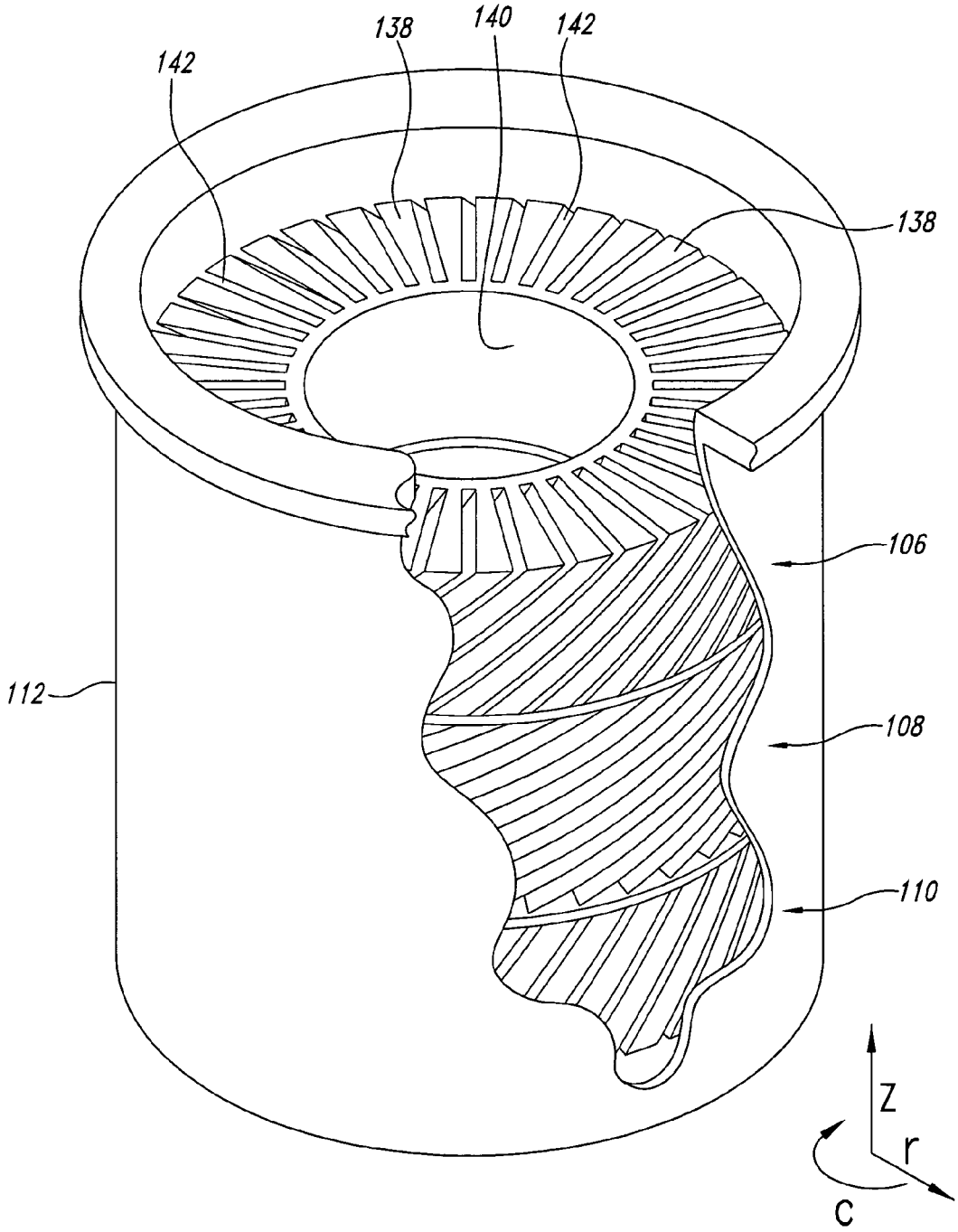

FIG. 23 is an isometric view of the stratified channelized regenerator with integrated heat exchangers shown integrated with a pressure vessel.

Figure 24:
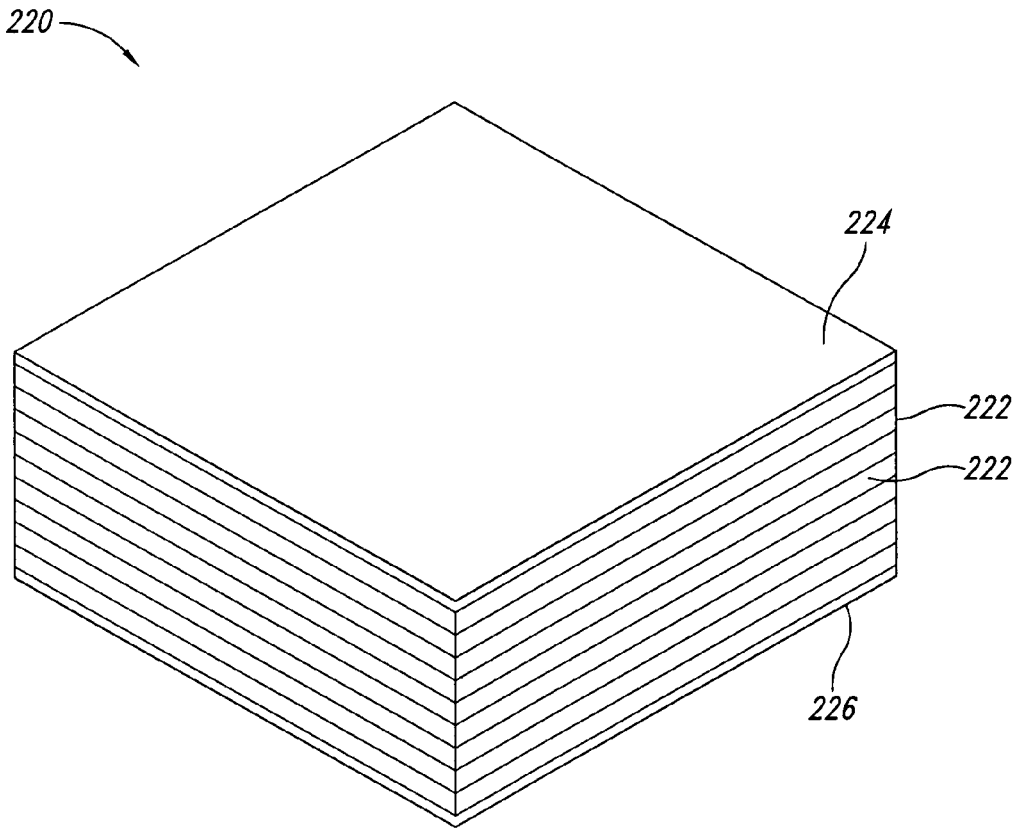

FIG. 24 is an isometric view of a regenerator portion.

DETAILED DESCRIPTION OF THE INVENTION

As will be discussed in greater detail herein, a channelized stratified regenerator with integrated heat exchangers system and method are disclosed using micromachining to precisely construct structural geometries and axial stratification of material. In operation, a working fluid passes through the regenerator when traveling between two heat exchangers. A first one of the two heat exchangers transfers heat from a heat source to the working fluid and a second one of the two heat exchangers transfers heat from the working fluid to a heat sink. With a Stirling cycle engine, the heat source can include chemical combustion, nuclear, solar, and other energy sources. Another heat exchanger can also be used to transfer heat from the energy source to the first heat exchanger. With a Stirling cycle cooler, a heat source is a room, device, or something else intended to be cooled. In some implementations, the heat sink can be another heat exchanger containing a coolant to carry heat off in a heat dissipation device. In some implementations, the regenerator and the heat exchangers are formed as a single construction. In other implementations, the regenerator and heat exchangers are formed separately, but are still constructed to integrate efficiently with one another.

With reference to an axial dimension and a radial dimension, the regenerator is constructed having closely spaced thin fins forming channels in which fin dimensions, fin spacing, and channel widths can be varied in a controlled fashion such as along the axial dimension and/or the radial dimension. The close spacing and the thinness of the regenerator fins provides sufficient contact surface area per volume of regenerator material to replace conventional random fiber mesh material thereby alleviating problems directly associated with use of the conventional random fiber mesh material.

Fin geometries for the regenerator include those in which fins are shaped to extend radially or concentrically from the axial dimension, or are shaped to swirl uniformly or non-uniformly around the axial dimension, or are shaped having combinations of these and other geometries to provide sufficient contact fin surface area per volume of regenerator mass to transfer heat between the fins and an associated working fluid in contact with the fins. Spacing of the regenerator channels can be varied in a controlled manner such as along the axial dimension to vary porosity and to shape the regenerator channels to integrate channels of the heat exchangers. Fin geometries also must allow for sufficient thickness of the fins in order to properly conduct heat to the associated working fluid.

Fin geometries for the heat exchangers typically include fins shaped to extend radially from the axial dimension, or are shaped to swirl uniformly or non-uniformly around the axial dimension, or are shaped having combinations of these and other geometries. Along with the geometries, the fins are sufficiently thick to provide sufficient contact fin surface area on external surfaces of the heat exchangers to either acquire or release heat from external heat sources or sinks. In some implementations, spacing of the heat exchanger channels can be varied in a controlled manner along the axial dimension to vary heat exchanger performance and to shape the channels of the heat exchangers to integrate with channels of the regenerator.

Through micromachining, small layers are individually laid down generally along the axial dimension (although another direction of depositing the layers is possible) to form and build up the final regenerator structure and the heat exchanger structures either as a single structure or as individual structures. The micromachining can be done through processes associated with chemical etching, laser deposition, or other conventional micromachining techniques. In some implementations, material composition of the layers can vary so that some layers of the regenerator can serve as thermal insulators in the axial direction whereas other layers can serve as thermal conductors in the radial direction to transfer heat between the working fluid and the fins and to retain heat in the fins. Materials for the various layers of the regenerator and heat exchangers can also be tailored depending upon the environmental conditions found in particular portions of the regenerator or the heat exchangers. For instance, near hotter areas, materials used may need to be more corrosion resistant than in cooler areas.

Figure 1:
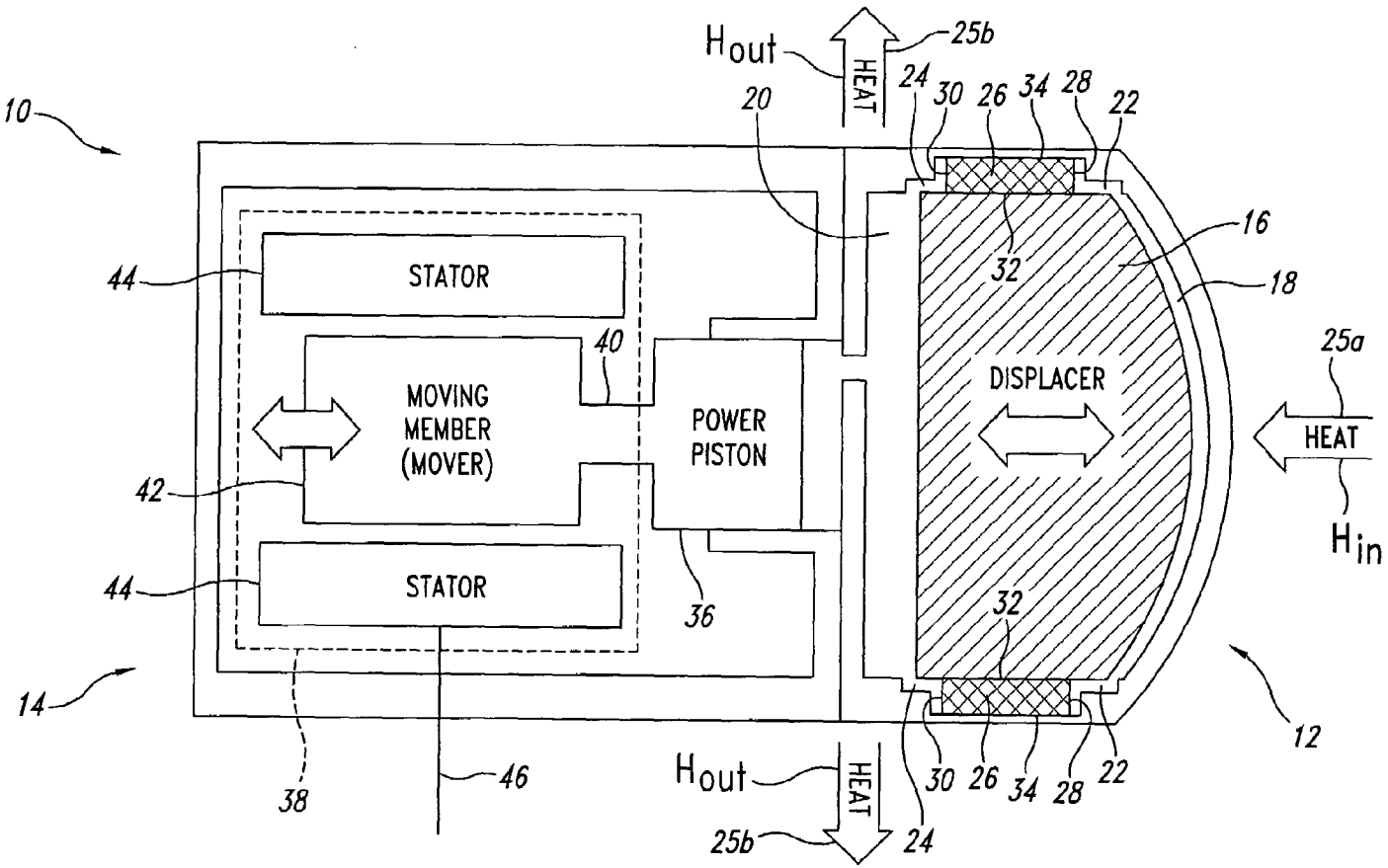
Fig. 1 (Prior Art)
FIG. 1 is a cross-sectional schematic of a conventional Stirling cycle system.

A simplified view of an exemplary conventional thermal regenerative machine 10 using a Stirling cycle module 12 and a power module 14 is shown in FIG. 1. In the implementation depicted, the Stirling cycle module 12 has a displacer 16 that is moved by pressure differences, which also cause working fluid to move between a first temperature area 18 and a second temperature area 20 by passing through a first passageway 22 coupled to the first temperature area 18 and a second passageway 24 coupled to the second temperature area 20. Typically a heat source 25*a* is positioned adjacent the first temperature area and near the first passageway 22 and a heat sink 25*b* is positioned adjacent the second passageway 24. A regenerator 26 has a first end surface 28, a second end surface 30, an interior surface 32, and an exterior surface 34. The regenerator 26 is positioned between the first passageway 22 and the second passageway 24 such that the first end surface 28 of the regenerator is adjacent the first passageway 22 and the second end surface 30 of the regenerator is adjacent the second passageway 24. Portions of the first passageway and the second passageway are shaped to maintain uniform flow of the working fluid and are consider to be "dead volume" since they take up volume without contributing to thermodynamic efficiency. When the first temperature area 18 is significantly higher in temperature than the second temperature area 20, the heat source 25*a* inputs heat to the working fluid in the first passageway 22 and the heat sink 25*b* takes heat from the working fluid in the second passageway 24. The regenerator 26 receives heat from the working fluid as the working fluid passes from the first passageway 22 to the second passagewvay 24. The regenerator 26 returns some of this received heat back to the working fluid as the working fluid passes back from the second passageway to the first passageway.

The second temperature area 20 is in fluid communication with a power piston 36, which is part of the power module 14. The power piston 36 of the power module 14 is connected to a conventional linear electrodynamic system 38 through a shaft 40 coupled to a mover 42. The conventional linear electrodynamic system 38 further includes a stator 44 and an electrical line 46 to furnish electrical power when the thermal regenerative machine 10 is used as an electrical generator and to receive electric power when the electrothermal system is used as a cooler. Other thermal regenerative machines can have other electromotive configurations besides a moving iron linear alternator or motor such as those utilizing moving magnets or kinematic arrangements with rotary alternators.

As described, the regenerator 26 serves to receive heat from the working fluid, retain the heat, and then return the retained heat back to the working fluid. Conventional random fiber mesh material has been found to be effective for these functions of the regenerator 26. Other materials have been used including wire screens and/or woven screens, porous materials, and those using short fibers, metals, plastics, powdered metals, and so forth. A typical method of conventional construction of the regenerator 26 involves sintering a compressed stack of loosely woven random fiber mesh sheets to form a porous unit of material commonly referred to as a brick. The brick is then machined to form the proper shape for the regenerator 26. Unfortunately, the conventional regenerator 26, the first passageway 22, the second passageway 24 and other conventional components have associated problems as described in part above.

Figure 2:
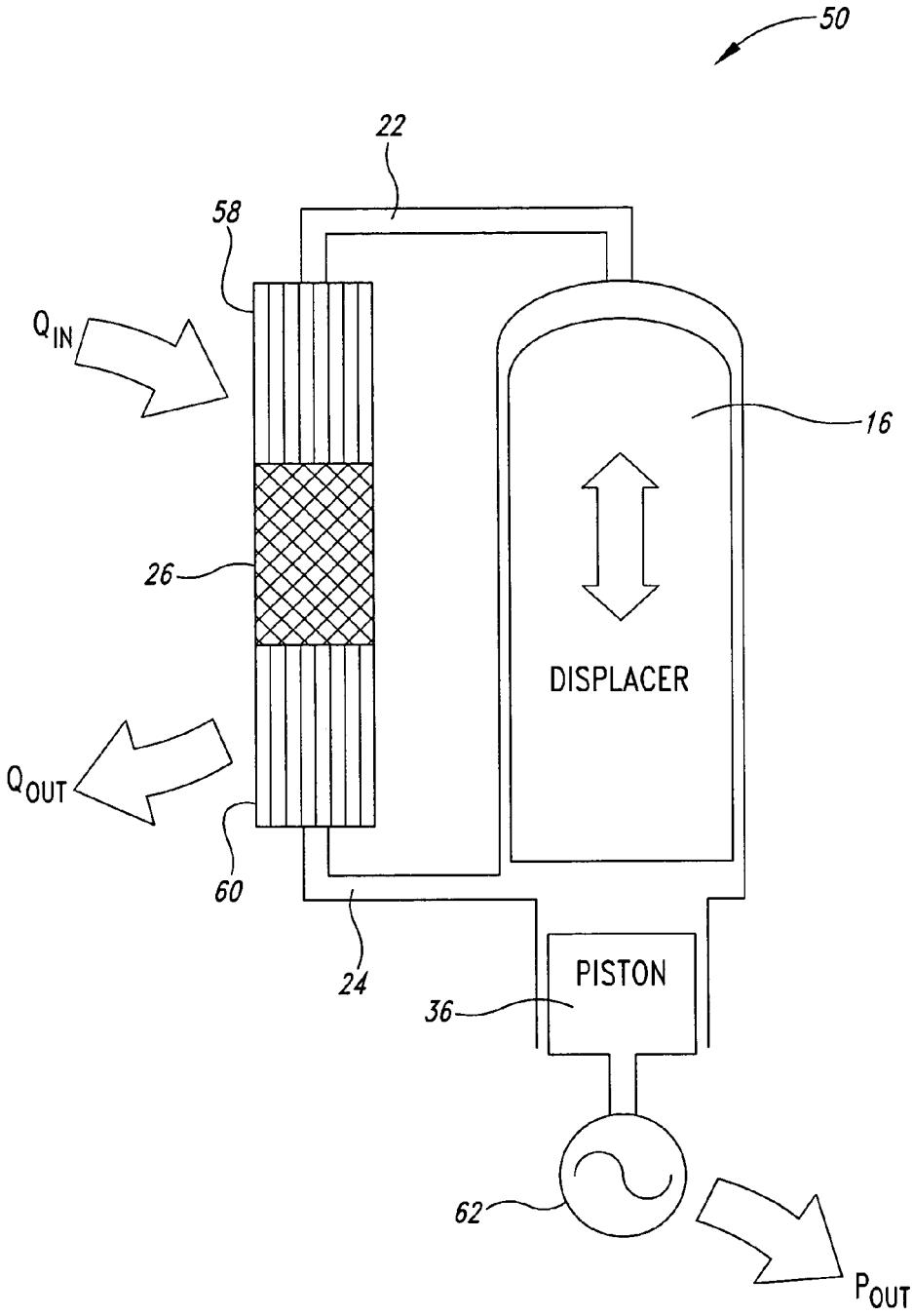
Fig. 2 (Prior Art)
FIG. 2 is a schematic of an exemplary engine implementation of a thermal regenerative machine.
Figure 3:
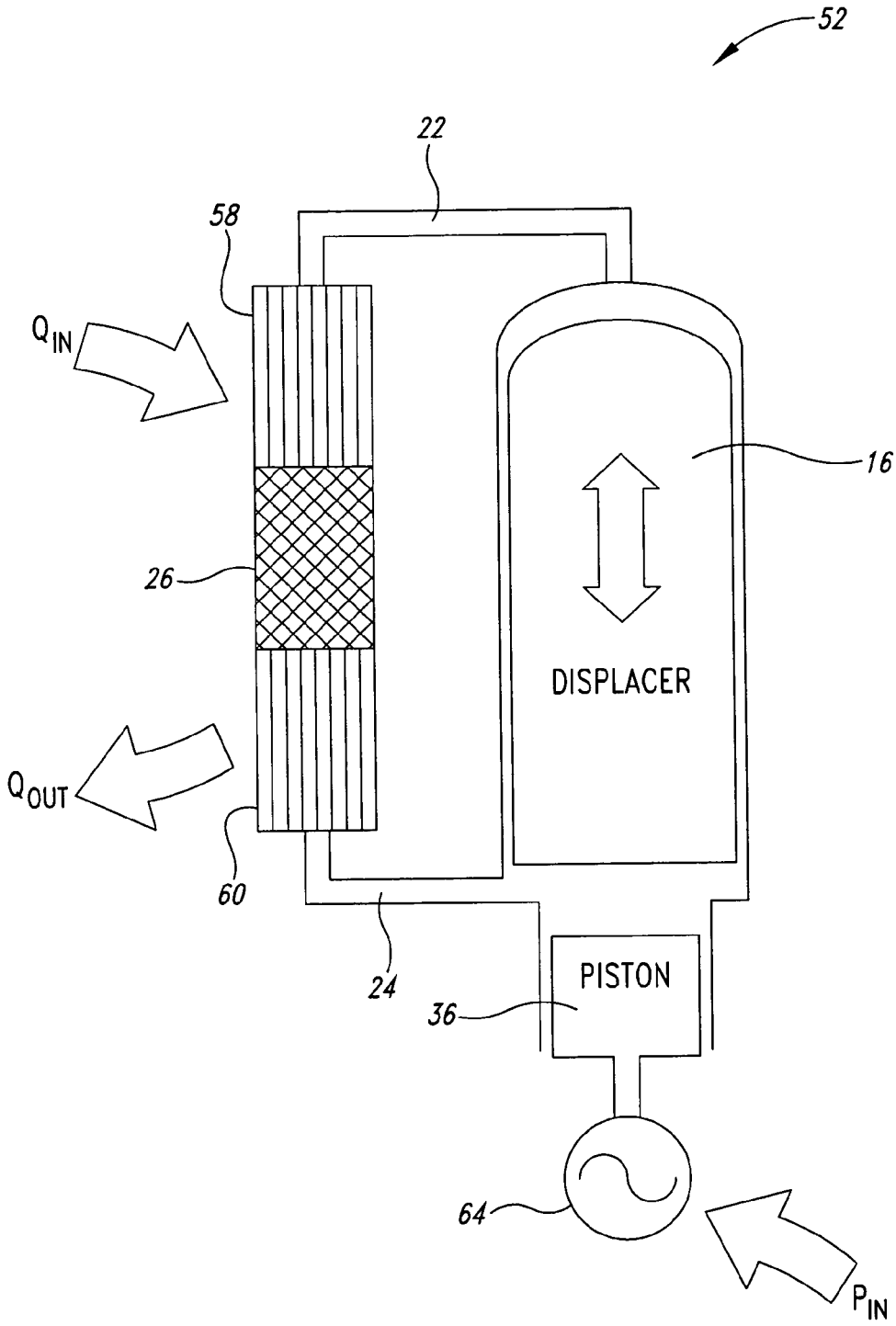
Fig. 3 (Prior Art)
FIG. 3 is a schematic of an exemplary cooler implementation of a thermal regenerative machine.
Figure 4:
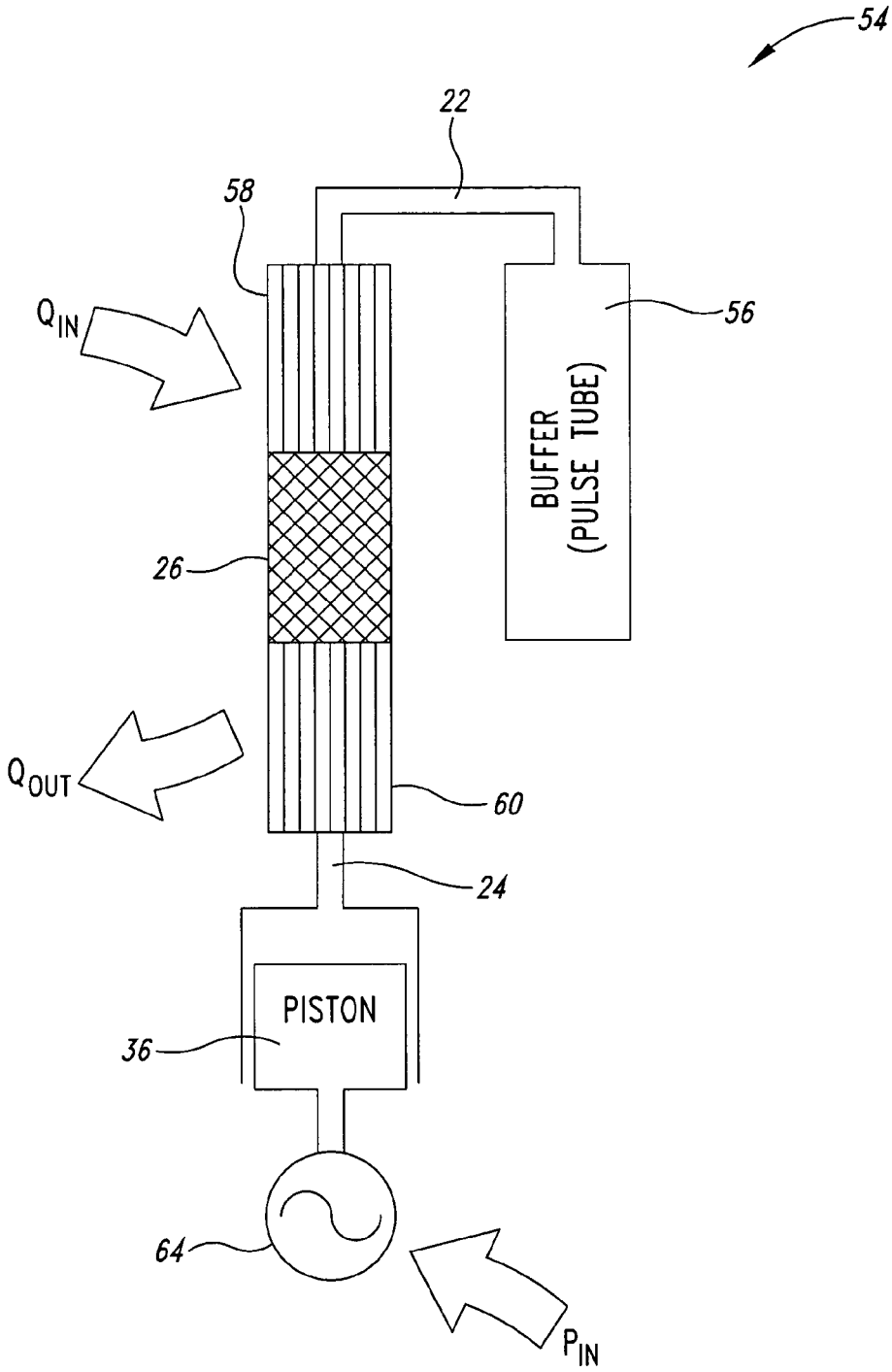
Fig. 4 (Prior Art)
FIG. 4 is a schematic of an exemplary pulse tube cooler implementation of a thermal regenerative machine.

As shown in FIGS. 2–4, the regenerator 26 is used in many different applications such as with the regenerative thermal machine 10 being used as an engine 50 to produce electrical power (FIG. 2), as a cooler 52 (FIG. 3) and as a special form of cooler called a pulse tube cooler 54 (FIG. 4) in which the displacer 16 is not present but a buffer chamber 56 is used according to conventional practice. As depicted, the regenerator 26 is typically positioned, in terms of working fluid flow, between a heat acceptor heat exchanger 58 that receives heat from a heat source and a heat rejector heat exchanger 60 that outputs heat to a heat sink. The power module 14 of the engine 50 is typically an alternator 62. The power module 14 of the cooler 52 and pulse tube cooler 54 is typically a motor 64.

An implementation of a enhanced thermal assembly 100 according to the present invention is shown in FIG. 5. The thermal assembly 100 includes a thermal exchange system 102 and a displacer 104. The displacer 104 is enclosed by an acceptor heat exchanger 106, a regenerator 108, and a rejector heat exchanger 110. A housing 112 further encloses the above identified components of the thermal exchange system 102. As a working fluid (not shown) travels from the acceptor 106 to the rejector 110, first the acceptor receives heat from a heat source 114 to transfer to the working fluid. The working fluid then gives up some of this heat to be retained by the regenerator 108. The rejector 110 then transfers some heat 116 remaining in the working fluid to an external heat sink (not shown). As the working fluid travels from the rejector 110 back to the acceptor 106, the working fluid passes again through the regenerator 108 where the working fluid receives some of the heat being retained by the regenerator. According to principles of the Stirling cycle, as the working fluid travels between the acceptor 106 and the rejector 110, the displacer 104 oscillates on flexure bearings 118 coupled to a support 120. Pressure differences cause the displacer 104 to oscillate with working fluid entering and exiting a hot area 122 through passageways 124 and a cold area 126 through passageways 128. The hot area 122 is bounded by interior surfaces 130 of the acceptor 106 and hot end surfaces 132 of the displacer 104, and so varies in size as the displacer moves. The cold area 126 is bounded by interior surfaces 134 of the rejector 110 and cold end surfaces 136 of the displacer 104, and so varies in size as the displacer moves.

Portions of swept fin implementations of the acceptor 106 and the rejector 110, and a swept fin implementation of the regenerator 108 are all shown integrated together in a cross-sectional view in FIG. 6 and in an isometric view in FIG. 7. In the depicted swept fin implementation, the acceptor 106 and the ejector 110 both have a plurality of fins 138 extending radially from an interior wall 140 in a perpendicular fashion from a longitudinal axis Z shown in FIG. 7. The ins 138 also extend in an axial direction at an angle to the longitudinal axis Z in an apparent twisting clockwise (other implementations are counterclockwise) fashion C when viewed from above in FIG. 7, which is the depicted implementation of a swept fin. Other swept fin implementations include variations of fin pitch angle and fin spacing for at least one of the acceptor 106, regenerator 108, or rejector 110, Other implementations may utilize curved fins for at least one of the acceptor 106, regenerator 108, or rejector 110. For instance, FIG. 6A and FIG. 6B depict the fin spacing and the fin pitch of the acceptor 106 being different than the that of the rejector 110 with the acceptor being shorter than the rejector in FIG. 6A and the acceptor being taller than the rejector in FIG. 6B. As another example, fins of the acceptor 106 are shown to be curved in FIG. 6C. Other implementations of swept fins include other radially extending fins that extend along the longitudinal axis Z with different or varying degrees of twist. For instance, some implementations include some portions having a counter-clockwise twist or have some or all fins that extend parallel with the longitudinal axis Z. The fins 138 are shown as having a uniform thickness, Tfe, and spaced apart by channels 142 with a width, Wce. Typically, the thickness, Tfe, of the fins 138 is significantly greater than the width, Wce, of the channels 142. In other implementations of the acceptor 106 and/or the rejector 110, the number and the thickness, Tfe, of the fins 138 and/or the width, Wce, of the channels 142 can vary. The acceptor 106 has an exterior wall 144 and the rejector 110 has an exterior wall 145, shown in FIG. 8 as being coupled to the exterior radial ends of the fins 138, which helps to support the fins.

The depicted swept fin implementation of the regenerator 108 is further shown in FIGS. 9 and 10 where the regenerator has a plurality of fins 146 having a number generally greater than the fins 138 of the acceptor 106 and the rejector 110. The fins 146 have a thickness, Tfr, and are spaced by channels 148 having a width, Wcr. Generally, the fins 146 are relatively thin with the channels having widths, Wcr, greater than the fin thickness Tfr, since the regenerator 108 is generally porous. In some implementations, fin thickness, Tfr, and channel width, Wcr, can vary especially along the longitudinal axis, Z. As shown, the fins 146 of the depicted swept fin implementation of the regenerator 108 generally share the clockwise twist shape of the fins 138 of the acceptor 106 and the rejector 110. In other implementations of the regenerator 108, the number and the thickness, Tfr, of the fins 146 and/or the width, Wcr, of the channels 148 can vary. The regenerator 108 further has an exterior wall 150 shown in FIG. 10 as being coupled to the exterior radial ends of the fins 138, which helps to support the fins.

An annular implementation of the regenerator 108 is shown in FIG. 9 as having looping fins such as concentric rings 152 with the interior wall 140 of the regenerator being the center ring and the other rings concentrically expanding about each other from a longitudinal axis, Z, in a radial direction, r. The rings 152 have a thickness, Trr, and are spaced apart from one another to form channels 154, therebetween, each having a width, Wcrr. As with the fins 146 of the regenerator implementation described above, the thickness, Trr, of the rings 152 of the depicted annular implementation of the regenerator 108 are relatively thin and the width, Wcrr, of the channels 154 between the rings is wide enough to support a certain porosity requirement for the regenerator.

In other implementations of the regenerator 108, the number and the thickness, Trr, of the rings 152 and/or the width, Wcrr, of the channels 154 can vary. The rings 152 are spaced apart from one another by being coupled to a plurality of swept spacers 156. As shown in FIGS. 11 and 12, the spacers 156 can share the general clockwise spiral shape or other twisting shape of the fins 146 of the regenerator 108 and the fins 138 of the acceptor 106 and the rejector 110 of the depicted swept fin implementation.

A straight radial implementation of the regenerator 108 is shown in FIGS. 13 and 14 as having fins 158 and channels 160 that extend radially from a longitudinal axis, Z, and extend longitudinally in parallel with the longitudinal axis, Z.

In some implementations, diffusers are used to better direct flow of the working fluid between the regenerator 108 and the acceptor 106 and between the regenerator and the rejector 110 for objectives such as to maintain uniform flow of the working fluid throughout the regenerator and consequently reduce "dead" volume compared with conventional approaches. In a depicted diffuser implementation integrating the regenerator 108 with the rejector 110 shown in FIGS. 15 and 16, three diffusers are placed between the regenerator and the rejector: a large hole diffuser 170 having relatively large sized passageways or holes 172, a medium hole diffuser 174 having smaller medium sized passageways or holes 176, and a small hole diffuser 178 having smaller sized passageways or holes 180. The large hole diffuser 170 occupies a position adjacent the rejector 110, the small hole diffuser 178 occupies a position adjacent the regenerator 108, and the medium hole diffuser 174 occupies a position between the small hole diffuser and the large hole diffuser. The large hole diffuser 170, the medium hole diffuser 174, and the small hole diffuser 178 have perimeter edging 181 that helps to separate the holed surfaces of the diffusers from one another when the diffusers are stacked on top of one another, for instance, as shown in FIG. 16.

Also shown in FIGS. 15 and 16, the straight radial implementation of the regenerator 108 as shown in FIGS. 13 and 14 can be paired with a straight radial implementation of the rejector 110 where the rejector has fins 182 extending radially from a longitudinal axis, Z, and further extending parallel with the longitudinal axis Z. The fins 182 of the straight radial implementation of the rejector 110 are separated to form channels 184 therebetween. Better shown in FIG. 17, the holes 172 of the large hole diffuser 170 are sized and positioned to direct the working fluid flowing between the channels 184 of the rejector 110 and the holes 176 of the medium hole diffuser 174. The holes 176 of the medium hole diffuser 174 are sized and positioned to direct the working fluid flowing between the holes 172 of the large hole diffuser 170 and the holes 180 of the small hole diffuser 178. The holes 180 of the small hole diffuser 178 are sized and positioned to direct the working fluid flowing between the holes 176 of the medium hole diffuser 174 and the channels 160 of the regenerator 108. Flow of the working fluid can be similarly directed between the regenerator 108 and the acceptor 106 by one or more diffusers such as another set of the large hole diffuser 170, the medium hole diffuser 174, and the small hole diffuser 178. Thicknesses of the diffusers can also be modified such as for example having equal thicknesses as shown in FIG. 17A.

In other implementations, instead of using diffusers, the acceptor 106 and/or the rejector 110 can be interfaced directly adjacent the regenerator 108 by widening channels of the acceptor and/or the rejector near the interface using chamfers 186 on the ends of the fins of the acceptor/rejector, as shown with the straight radial implementation of the rejector 110 is shown in FIG. 18. Alternatively, the chamfers 186 of the acceptor 106 and/or the rejector 110 can be used with one or more of the diffusers to interface the acceptor and/or the rejector with the regenerator 108, as shown in FIG. 19. In another alternative implementation, radiused ends 187 of the acceptor 106 and/or the rejector 110 can be used with one or more of the diffusers to interface the acceptor and/or the rejector with the regenerator 108, as shown in FIG. 20.

Micromachining provides advantages in constructing the various geometries involved with the regenerator 108 and/or the acceptor 106 and the rejector 110 described above. The layered approach of micromachining also allows for the regenerator 108 and/or the acceptor 106 or the rejector 110 to have discrete layers with different geometries and/or materials. For instance, the multilayered implementation of the regenerator 108, shown in FIG. 21, has six layers: layer 188 through layer 196 with an insulation component 198 formed between each of the layers. In the depicted multilayered implementation of the regenerator 108, each of layer 188 through layer 196 is constructed so that the regenerator has a porosity gradient. Conventional methods of producing regenerators, such as foil regenerators, can involve rolling a thin sheet of material with dimples or spacers used to provide channels for flow. These conventional methods can be highly work intensive and can have inconsistent results for channel shape and dimensions. Micromachining allows for consistent channel shape and dimensions to more reliably achieve high operational performance.

Typically, it is desirable to have a greater porosity of the regenerator 108 toward the hotter end of the regenerator, which is generally located toward the acceptor 106. As shown in FIG. 21, the layer 188 is near the hot end of the regenerator 108 so the layer 188 has a higher porosity than the layer 190, the layer 190 has a higher porosity than the layer 192, and so on. To increase porosity, channel width is increased so for example, since the layer 188 has a higher porosity than the layer 190, the channels found in the layer 188 would be wider than the channels found in the layer 190, and the layer 188 would have typically have fewer fins than the layer 190.

The regenerator 108 is used to store energy received from the working fluid at a portion of the associated thermodynamic cycle involved and to return heat back into the working fluid at another portion of the associated thermodynamic cycle to enhance thermodynamic efficiency. In general, the degree of porosity of the regenerator 108 for efficient energy storage by the regenerator depends on temperature of the working fluid. At relatively high temperature, the value for specific heat of solid material making up the regenerator 108 is typically large. Consequently, a smaller amount of material is needed to retain a certain amount of heat so that the regenerator 108 can be of high porosity regenerators can be used.

At relatively low temperatures, due to decreased specific heat of the regenerator material, more material is needed to store a certain amount of heat compared with higher temperatures. As an example, Stirling engines typically use 70% to 90% regenerator porosity levels while cryocoolers with colder temperatures than the Stirling engines often use 30% to 60% regenerator porosity levels. Regenerators having low porosity levels typically have large pressure differentials across the regenerator due to frictional losses. Providing design options for varying regenerator porosity for different portions of the regenerator 108 dependent on factors such as local temperature of the regenerator portion will assist in satisfying competiting requirements of the regenerator to store sufficient heat while keeping frictional losses in check.

In some implementations, types of diffusers or chamfers are used to better direct flow of the working fluid between the layers of the regenerator 108. For instance, similar to those described above, chamfers (not shown in FIG. 21) could be located in the channels found in the layer 188 near the layer 190 since the channels in the layer 190 are generally more narrow than the channels in the layer 188. Diffusers (not shown in FIG. 21) could also be fabricated into the regenerator 108 by micromachining them in between the layers 188 through 196 of the regenerator shown in FIG. 21 to better direct flow of the working fluid as described above.

The acceptor 106 and the rejector 110 are both thermally coupled to the housing 112 either by brazening as depicted in FIG. 22, by being formed along with the regenerator 108 as an integral whole as depicted in FIG. 23, or by other means to bond the acceptor and rejector heat exchangers to the housing. The insulation components 198 formed between the layers 188 through 196 could be shaped as one or more stacked diffusers between each of the layers. In other implementations, the insulation components 198 could be formed as chamfers in the layer of each pair that has the wider channels to also better direct flow of the working fluid as described above. In some implementations, the insulation components 198 are located elsewhere in the regenerator 108. For instance, one of the insulation components 198 could be located in a midportion of one of the layers rather than between two different layers such that layer material on either side of the insulation component have the same geometry and material composition.

Furthermore, layers of the acceptor 106, the regenerator 108, and/or the rejector 110 could be made of different materials. As an example, for the regenerator 108, the layers 188 through 196 could be micromachined to be composed of different types of materials or different ratios of the same kinds of materials. For instance, since the layer 188 is closest to the hot end of the regenerator 108, the layer 188 could be made of special corrosion resistant materials that withstand temperatures higher than those experienced by the layer 196. The layer 190 could have less of the particular corrosion resistant materials than the layer 188 since the layer 190 is farther from the hot end than the layer 188. Corrosion resistant materials can contain alloys, which are less likely to oxidize under higher temperatures such as those representative alloys having aluminum oxide, nickel, Inconel 601, Inconel 718, and/or FeCrAlloy or other alloys, with sufficient content of particular metals, such as chromium content, to be resistant to oxidation at high temperature operation. For instance, other stainless steels having a high chromium content, such as stainless steel 309, stainless steel 310S, stainless steel 310SST, stainless steel 310LSST or special alloys with a minimum chromium content, such as at least 18% chromium content, allow for formation of protective oxide scale. For instance, stainless steel 310SST and stainless steel 310LSST have been reported to have a chromium content of 24% to 26%. Stainless steel 309 has been reported to have a chromium content of 22% to 24%.

The layer 196 and the layers near to the layer 196 could have less of the corrosion resistant elements than found in the layer 188 since they are closer to the cold end of the regenerator 108. For instance, alloys such as stainless steel 316 may be useful for the layer 196 under particular applications even though it would not be as useful for the layer 188 since the temperature involved in these particular applications would cause corrosion of the layer 188 at the hot end if this alloy was used whereas the alloy would be sufficient to resist corrosion for the layer 196 at the cold end for the temperatures involved. Possible cost reduction can be experienced by utlizing materials of lower corrosion resistance in areas not requiring higher corrosion resistance since high corrosion resistant materials tend to have higher associated cost than materials of lower corrosion resistance. Additionally other layers comprising various portions of the acceptor 106 and/or the rejector 110 could have materials with various levels of corrosion resistance depending upon operational requirements.

Regarding use of corrosion resistant materials with the regenator 108, in addition to micromachining, a sintering process could be utilized instead. The regenerator 108 could be assembled as sintered layers, a portion 220 of which is depicted in FIG. 24 as having inner layers 222, first end layer 224 and second end layer 226. The inner layers 222, the first end layer 224, and the second end layer 226 could be constructed first as individual sintered units and then assembled together into the regenerator portion 220. Alternatively, the inner layers 222, the first end layer 224, and the second end layer 226 of the regenerator portion 220 could be made from individual sheets of material having various levels of corrosion resistance and then stacked in juxtaposition and sintered together to form the regenerator 108. Machining procedures such as eletrical discharge machining could be used to form the final shape of the regenerator 108 once sintering had been performed. In some implementations, increasing sintering time increases bond strength between dissimilar materials such as with a bond involved with a combination of stainless steel 316L and Inconel 601.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. For a Stirling cycle based system having a first heat exchanger to transfer heat from a heat source to a working fluid and a second heat exchanger to transfer heat from the working fluid to a heat sink, the first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger, the regenerator comprising:

a plurality of fins shaped to at least partially twist about the first dimension, the fins positioned and spaced apart from one another to form channels, therebetween, the channels being positioned within the Stirling cycle based system to each extend along a majority of the first dimension between the first heat exchanger and the second heat exchanger and to direct at least partial passage of the working fluid between the first heat exchanger and the second heat exchanger along a pathway at least partially twisting about the first dimension to cause the working fluid to travel a longer distance in going between the first heat exchanger and the second heat exchanger than it would if the working fluid would travel entirely along the first dimension between the first heat exchanger and the second heat exchanger.

2. The system of claim 1 wherein the fins at least partially twist about the first dimension in a substantially spiral form.

3. For a Stirling cycle based system having a first heat exchanger to transfer heat from a heat source to a working fluid and a second heat exchanger to transfer heat from the working fluid to a heat sink, a regenerator positioned within the Stirling cycle based system to contact a portion of the working fluid as the working fluid moves between the first heat exchanger and the second heat exchanger, the regenerator comprising:

a plurality of fins positioned and spaced apart from one another to form channels, therebetween, each channel having a channel width, shape and orientation to achieve a desired amount of porosity for a portion of the regenerator, the fins being positioned and spaced apart to achieve varying amounts of porosity within the regenerator, the channels extending between the first heat exchanger and a first location having channel widths greater than a first channel width, the channels extending from the first location to the second heat exchanger having channel widths smaller than the first channel width.

4. For a Stirling cycle based system having a first heat exchanger to transfer heat from a heat source to a working fluid and a second heat exchanger to transfer heat from the working fluid to a heat sink, the first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger, the regenerator comprising:

a plurality of fins positioned and spaced apart from one another to form channels, therebetween, each channel having a channel width, shape and orientation with respect to the first dimension to achieve varying regenerator porosity dependent at least in part upon location along the first dimension, the regenerator porosity being greater than a first porosity between the first heat exchanger and a first location and smaller than the first porosity between the first location and the second heat exchanger.

5. For a Stirling cycle based system having a first heat exchanger to transfer heat from a heat source to a working fluid and a second heat exchanger to transfer heat from the working fluid to a heat sink, the first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger, the regenerator comprising:

a plurality of looping fins; and a plurality of spacers coupled to the looping fins to position and concentrically space apart the looping fins from one another to form concentric channels, therebetween, the spacers being positioned within the Stirling cycle based system to direct at least partial passage of the working fluid through the concentric channels between the first heat exchanger and the second heat exchanger along a pathway other than along the first dimension to cause the working fluid to travel a longer distance in going between the first heat exchanger and the second heat exchanger than it would if the working fluid would travel entirely along the first dimension between the first heat exchanger and the second heat exchanger.

6. The system of claim 5 wherein the looping fins are rings.

7. For a Stirling cycle based system having a first heat exchanger to transfer heat from a heat source to a working fluid and a second heat exchanger to transfer heat from the working fluid to a heat sink, the first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger, the regenerator comprising:

a plurality of looping fins; and a plurality of spacers coupled to the looping fins to position and concentrically space apart the looping fins from one another to form concentric channels, therebetween, the spacers shaped to at least partially twist about the first dimension and positioned within the Stirling cycle based system to direct within the concentric channels at least partial passage of the working fluid between the first heat exchanger and the second heat exchanger along a pathway at least partially twisting about the first dimension to cause the working fluid to travel a longer distance in going between the first heat exchanger and the second heat exchanger than it would if the working fluid would travel entirely along the first dimension between the first heat exchanger and the second heat exchanger.

8. For a Stirling cycle based system having a first heat exchanger to transfer heat from a heat source to a working fluid and a second heat exchanger to transfer heat from the working fluid to a heat sink, the first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger, the regenerator comprising:

a cylindrical member centrally positioned within the regenerator along the first dimension, the cylindrical member having an exterior surface; and a plurality of fins extending radially from the exterior surface of the cylindrical member, the fins positioned and spaced apart from one another to form channels, therebetween, the channels being positioned within the Stirling cycle based system to direct at least partial passage of the working fluid between the first heat exchanger and the second heat exchanger along a pathway other than along the first dimension to cause the working fluid to travel a longer distance in going between the first heat exchanger and the second heat exchanger than it would if the working fluid would travel entirely along the first dimension between the first heat exchanger and the second heat exchanger.

9. For a Stirling cycle based system having a first heat exchanger to transfer heat from a heat source to a working fluid and a second heat exchanger to transfer heat from the working fluid to a heat sink, the first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger, the regenerator comprising:

a plurality of fin layers, each fin layer having a plurality of fins positioned and spaced apart from one another to form channels, therebetween, the channels being positioned within the Stirling cycle based system to direct at least partial passage of the working fluid between the first heat exchanger and the second heat; and a plurality of insulation components, each insulation component having openings, each insulation component positioned between two different pairs of fin layers to align the openings of the insulation component with the channels of the fin layers to direct flow of working fluid between the channels of the fin layers, the insulation components having lower thermal conductances than the fin layers.

10. For a Stirling cycle based system having a first heat exchanger to transfer heat from a heat source to a working fluid and a second heat exchanger to transfer heat from the working fluid to a heat sink, the first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger, the regenerator comprising:

a plurality of fin layers, each fin layer having a plurality of fins positioned and spaced apart from one another to form channels, therebetween, the channels being positioned within the Stirling cycle based system to direct at least partial passage of the working fluid between the first heat exchanger and the second heat exchanger; a first of the fin layers having a fewer number of fins than a second of the fin layers; and a plurality of diffusers, each of the diffusers having passageways, each of the diffusers positioned between a pair of the fin layers to align the passageways of the diffuser with the channels of the fin layers to direct flow of working fluid between the fin layers of the pair.

11. For a Stirling cycle based system having a first heat exchanger to transfer heat from a heat source to a working fluid and a second heat exchanger to transfer heat from the working fluid to a heat sink, the first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger, the regenerator comprising:

a plurality of fin layers, each fin layer having a plurality of fins positioned and spaced apart from one another to form channels, therebetween, the channels being positioned within the Stirling cycle based system to direct at least partial passage of the working fluid between the first heat exchanger and the second heat; a first of the fin layers having a higher melting point than a second of the fin layers.

12. For a Stirling cycle based system having a first heat exchanger to transfer heat from a heat source to a working fluid and a second heat exchanger to transfer heat from the working fluid to a heat sink, a method of forming a portion of a regenerator, the regenerator positioned within the Stirling cycle based system to contact a portion of the working as the working fluid moves between the first heat exchanger and the second heat exchanger, the method comprising:

forming the regenerator from a plurality of material layers by micromachining to define passages shaped and positioned to direct flow of the working fluid through the passages between the first heat exchanger and the second heat exchanger.

13. The method of claim 12 wherein forming the regenerator produces fins that define the passages.

14. For a Stirling cycle based system having a first heat exchanger and a second heat exchanger, a regenerator positioned within the Stirling cycle based system to contact a portion of the working fluid as the working fluid moves between the first heat exchanger and the second heat exchanger, the regenerator comprising:

a plurality of fins positioned and spaced apart from one another to form channels, therebetween, each channel having a channel width, shape and orientation to achieve a desired amount of porosity for a portion of the regenerator, the fins being positioned and spaced apart to achieve varying amounts of porosity within the regenerator, the channels extending between the first heat exchanger and a first location having channel widths smaller than a first channel width, the channels extending from the first location to the second heat exchanger having channel widths greater than the first channel width.

15. For a Stirling cycle based system having a first heat exchanger and a second heat exchanger, first heat exchanger and the second heat exchanger positioned according to a first dimension defining a shortest distance between the first heat exchanger and the second heat exchanger, a regenerator positioned within the Stirling cycle based system to contact a portion of the working fluid as the working fluid moves between the first heat exchanger and the second heat exchanger, the regenerator comprising:

a plurality of fins positioned and spaced apart from one another to form channels, therebetween, each channel having a channel width, shape and orientation with respect to the first dimension to achieve varying regenerator porosity dependent at least in part upon location along the first dimension, the regenerator porosity being smaller than a first porosity between the first heat exchanger and a first location and greater than the first porosity between the first location and the second heat exchanger.

* * * * *